US008020502B2

(12) United States Patent
Hanada

(10) Patent No.: US 8,020,502 B2
(45) Date of Patent: Sep. 20, 2011

(54) THREAD CUTTING DEVICE OF SEWING MACHINE

(75) Inventor: Tsuyoshi Hanada, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 796 days.

(21) Appl. No.: 12/101,306

(22) Filed: Apr. 11, 2008

(65) Prior Publication Data

US 2008/0250995 A1 Oct. 16, 2008

(30) Foreign Application Priority Data

Apr. 13, 2007 (JP) ..... 2007-106229

(51) Int. Cl.
*D05B 65/00* (2006.01)

(52) U.S. Cl. ..... 112/285

(58) Field of Classification Search ..... 112/291, 112/292, 293, 295, 296, 298, 285, 302
See application file for complete search history.

(56) References Cited

U.S. PATENT DOCUMENTS

| | | | | |
|---|---|---|---|---|
| 4,407,210 | A * | 10/1983 | Jung et al. | 112/167 |
| 5,937,776 | A * | 8/1999 | Ogawa et al. | 112/292 |
| 6,076,477 | A * | 6/2000 | Badillo | 112/231 |
| 6,672,232 | B2 * | 1/2004 | Enns et al. | 112/291 |
| 7,603,957 | B2 * | 10/2009 | Shiraishi | 112/298 |

FOREIGN PATENT DOCUMENTS

| | | |
|---|---|---|
| JP | 47-823 | 1/1972 |
| JP | 51-88347 | 8/1976 |
| JP | 3106472 | 9/2000 |

* cited by examiner

*Primary Examiner* — Tejash Patel
(74) *Attorney, Agent, or Firm* — Drinker Biddle & Reath LLP

(57) ABSTRACT

The thread cutting device of a sewing machine provides a first thread catching member having a first thread catching portion for catching a thread positioned between the horizontal shuttle and the needle hole and carrying out forward and backward movements below the throat plate while the first thread catching portion catches the thread, a second thread catching member having a second thread catching portion for catching the thread laid between the needle hole and the first thread catching portion and guiding the thread caught by the first thread catching member to a fixed blade and to cut the thread by the fixed blade.

7 Claims, 19 Drawing Sheets

THREAD CUTTING DEVICE OF SEWING MACHINE

The present invention claims priority from Japanese Patent Application No. 2007-106229 filed on Apr. 13, 2007, the entire content of which is incorporated herein by reference.

BACKGROUND OF INVENTION

1. Field of the Invention

The present invention relates to a thread cutting device of a sewing machine which serves to guide a thread caught by a thread catching member to a fixed blade and to cut the thread by the fixed blade.

2. Description of the Related Art

Conventionally, a thread cutting device of a sewing machine which serves to cut a thread such as a needle thread or a bobbin thread in the end of a sewing work over a horizontal shuttle (for example, see JP-B-3106472) is provided with a thread catching body 610 provided in a sewing machine bed and serving to receive a power from a lower shaft to be driven by a sewing machine motor, thereby carrying out forward and backward movements (see FIG. 20A). In the forward and backward movements of the thread catching body 610, a bobbin thread T is caught by a forked thread catching portion provided on a tip of the thread catching body 610 and is then guided to a fixed blade so that the bobbin thread T is cut.

In some cases, a servomotor is utilized as a motor to be employed as the sewing machine motor. In general, it is hard to control the servomotor in a low speed region. For this reason, it is difficult to set an operating speed of the thread catching body 610 interlocked with the lower shaft to be sufficiently low. In the case in which the bobbin thread T passed from a bobbin 240 is caught by the thread catching body 610, therefore, the bobbin thread T is pulled vigorously in the catching operation so that the bobbin 240 is excessively rotated and the bobbin thread T is excessively passed (see FIG. 20B). There is a problem in that sewing quality is deteriorated in a next sewing work due to the excessive pull-out.

In consideration of the problems, in recent years, there has also been developed a thread cutting device of a sewing machine having a structure in which a stepping motor is used as a driving source of the thread catching body 610 in a thread catching work to catch the bobbin thread T at a low speed and the bobbin thread T and a needle thread are cut by a great force through a driving force of the sewing machine motor in a cutting work.

It is preferable that the needle thread and the bobbin thread T which are connected to a cloth side after a cutting work carried out through the thread cutting device should have smaller lengths from the cloth to a thread end in order to have excellent finishing for a workpiece. When the length to the thread end connected to the cloth is long, an operator cuts the thread to be short by a hand. For this reason, a working efficiency is remarkably reduced. On the other hand, in the case in which the needle thread and the bobbin thread T which remain on a needle side of the sewing machine after the cutting work do not have proper lengths, the thread end slips from the needle at a next sewing start so that a seam may not be reliably formed. Therefore, a work for inserting the thread into the needle is required again so that the working efficiency is reduced. Furthermore, a hole is formed on the cloth through the needle. Consequently, quality of a workpiece is reduced.

A thread cutting device of a conventional sewing machine which serves to cut a thread by a thread catching body and a fixed blade has such a structure that the needle thread and the bobbin thread T are caught and cut in a close position to a needle hole of a throat plate. A length of a residual end of the thread remaining on the needle side after the cutting work is to be maintained. There is a problem in that a length of the residual end of the thread remaining on the cloth side after the cutting work is also increased correspondingly (see FIG. 21).

SUMMARY OF INVENTION

In one or more embodiments of the invention, a thread cutting device of a sewing machine serves to cut a thread in a proper length.

A first aspect of the invention is directed to a thread cutting device of a sewing machine which is disposed below a throat plate having a needle hole through which a needle penetrates and serves to cut at least one of a needle thread and a bobbin thread which are positioned between a horizontal shuttle and the needle hole, comprising a first thread catching member (110) having a first thread catching portion (111) for catching a thread positioned between the horizontal shuttle and the needle hole and serving to carry out forward and backward movements below the throat plate in a state in which the first thread catching portion catches the thread, a second thread catching member (120) having a second thread catching portion (121) for catching the thread laid between the needle hole and the first thread catching portion and serving to guide the thread caught by the first thread catching member to a fixed blade and to cut the thread by the fixed blade, and an operating device (180, 200) for causing the second thread catching member to carry out a catching operation and a cutting operation after the catching operation of the first thread catching member.

A second aspect of the invention is directed to the thread cutting device of a sewing machine according to the first aspect of the invention, wherein the operating device includes at least a stepping motor (180) serving as a driving source for the catching operation of the first thread catching member.

A third aspect of the invention is directed to the thread cutting device of a sewing machine according to the second aspect of the invention, wherein the operating device includes a first cam member (160) provided on a lower shaft to be rotated by a sewing machine motor, a second cam member (170) provided side by side with the first cam member and driven by the stepping motor, a first power transmitting member (130) having a follower capable of abutting on drivers of both the first cam member and the second cam member and serving to transmit a power for forward and backward movements from the first and second cam members to the first thread catching member, a second power transmitting member (140) having a follower capable of abutting on drivers of both the first cam member and the second cam member and serving to transmit a power for forward and backward movements from the first and second cam members to the second thread catching member, and cutting control means for driving the stepping motor to move the first thread catching member, thereby catching the thread, and then driving the sewing machine motor to move the second thread catching member, thereby cutting the thread.

A fourth aspect of the invention is directed to the thread cutting device of a sewing machine according to the third aspect of the invention, wherein the first cam member is an end cam (161, 162) having drivers on both end faces in a axis direction of the lower shaft, and the second cam member is a cylindrical cam (174) disposed concentrically with the first cam member and retaining the first cam member on an inside, and having drivers on a peripheral surface thereof and one of the end faces in the axis direction of the lower shaft.

A fifth aspect of the invention is directed to the thread cutting device of a sewing machine according to the third or fourth aspect of the invention, wherein the driver of the second cam member has an abutting portion for moving the first thread catching member and the second thread catching member backward, thereby holding each of the followers in a position in which any of the driver of the first cam member and the respective followers are not engaged with each other.

A sixth aspect of the invention is directed to the thread cutting device of a sewing machine according to any of the third to fifth aspects of the invention, wherein the second cam member has the drivers on the peripheral surface and one of the end faces in the axis direction of the lower shaft which serve to guide the respective followers so as to move both the first thread catching member and the second thread catching member from a rearmost position to a foremost position through a normal rotation of the stepping motor and to then dispose the first thread catching member in a thread catching position in the middle of the backward movement while disposing the second thread catching member in the foremost position through a reverse rotation of the stepping motor, and the first cam member has the drivers on both of the end faces in the axis direction of the lower shaft which serve to guide the respective followers so as to backwardly move the first thread catching member catching the thread to the rearmost position while disposing the second thread catching member in the foremost position through a driving operation of the sewing machine motor and to then move the second thread catching member to the rearmost position.

A seventh aspect of the invention is directed to the thread cutting device of a sewing machine according to any of the first to sixth aspects of the invention, wherein the second thread catching member passes through a height in which the thread laid between the thread catching portion of the first thread catching member and the needle hole may be caught by the thread catching portion.

According to the first aspect of the invention, by the operating device, the thread is caught by the first thread catching member, and furthermore, the thread laid between the thread catching portion of the first thread catching member and the needle hole of the throat plate is then caught by the thread catching portion of the second thread catching member, and is guided to the fixed blade and is thus cut by the fixed blade. In other words, it is possible to cut a portion of the thread which is closer to the needle hole as compared with a thread cutting device of a conventional sewing machine which comprises only the first thread catching member and serves to cut the thread by the first thread catching member and the fixed blade. Accordingly, it is possible to reduce a length of a residual end of the thread remaining on the cloth side after cutting the thread to have a proper length. In addition, since the thread is folded back by the first thread catching member, it is possible to maintain the residual end of the thread remaining on the sewing machine side to have a greater length than that in the conventional art (see FIG. 19). Consequently, it is possible to reduce a labor and a time which are required for a processing for the residual end of the thread which remains on the cloth side and to efficiently entangle the thread in a next sewing work. Thus, it is possible to enhance an efficiency of the work.

According to the second aspect of the invention, the operating device includes at least the stepping motor serving as the driving source for the catching operation of the first thread catching member. Consequently, it is possible to carry out the operation for catching the thread through the first thread catching member at a low speed by setting the operating speed of the stepping motor to be low when catching the thread. Accordingly, it is possible to prevent excessive pull-out in which the thread is excessively pulled out of a bobbin.

According to the third aspect of the invention, each of the first power transmitting member and the second power transmitting member has the followers capable of abutting on the drivers of both the first cam member to be operated by the sewing machine motor and the second cam member to be operated by the stepping motor. By driving one of the cam members corresponding to a shape of the driver in each of the cam members, consequently, it is possible to selectively switch the driving sources of the first thread catching member and the second thread catching member into one of the sewing machine motor and the stepping motor. Thus, the driving source for catching the thread and the driving source for cutting the thread may be selectively switched into one of the sewing machine motor and the stepping motor.

According to the third aspect of the invention, moreover, the cutting control means uses the stepping motor as the driving source to drive the first thread catching member, thereby catching the thread, and then drives the sewing machine motor to drive the second thread catching member so that the thread guided to the fixed blade through the second thread catching member is cut. In other words, it is possible to pull the thread out at a low speed by using the stepping motor as the driving source for the first thread catching member when catching the thread. By using the sewing machine motor as the driving source for cutting the thread through the second thread catching member. Furthermore, it is possible to cut the thread by a greater force when the stepping motor is used as the driving source for cutting. Accordingly, it is possible to execute the thread cutting operation without considering a type of the thread to be used (for example, a thickness or a hardness). Therefore, it is possible to prevent a thread cutting failure.

According to the fourth aspect of the invention, the second cam member is set to be the cylindrical cam having the drivers on the peripheral surface and one of the end faces in the axis direction and the second cam member has such a structure as to be disposed concentrically with the first cam member and to retain the first cam member on the inside. Furthermore, the first cam member is set to be the end cam having the drivers on both of the end faces. Consequently, it is possible to smoothly carry out the operations for catching and cutting the thread with a simple structure while reducing a space for the thread cutting device of the sewing machine.

According to the fourth aspect of the invention, moreover, it is possible to operate the first thread catching member and the second thread catching member in desirable timings and moving amounts with a simple structure by forming the respective drivers of the first cam member and the second cam member which are to be rotated axially in desirable phases and guiding amounts, for example. In addition, it is possible to set a relationship of an operation timing and a moving amount between the first thread catching member and the second thread catching member by setting the respective drivers formed on both of the end faces of the first cam member and the respective drivers formed on the peripheral surface and one of the end faces in the second cam member to have desirable phases and guiding amounts.

According to the fifth aspect of the invention, the respective followers of the first power transmitting member and the second power transmitting member are moved backward and held in a position in which they are not engaged with the driver of the first cam member through the abutting portion provided in the driver of the second cam member. Accordingly, the respective followers are held in the abutting portion during a sewing work. Consequently, it is possible to prevent an interference of the driver of the first cam member to be rotated together with the lower shaft and the respective followers of the first power transmitting member and the second power transmitting member. Thus, it is possible to implement a smooth sewing operation.

According to the sixth aspect of the invention, a the second cam member disposes the first thread catching member in the thread catching position in the middle of the backward movement while disposing the second thread catching member in the foremost position. For example, consequently, the thread catching portion of the first thread catching member in the thread catching position is disposed close to the thread catching portion of the second thread catching member in the foremost position. Thus, it is possible to efficiently cause all of the thread catching portions to catch the thread caught by the shuttle interlocked with the sewing machine motor and passed through the shuttle when driving the sewing machine motor.

According to the sixth aspect of the invention, moreover, there is employed the structure in which the first thread catching member catching the thread is moved backward to the rearmost position with the second thread catching member disposed in the foremost position. Consequently, by providing the thread catching portion of the second thread catching member disposed in the foremost position on a line connecting the needle hole of the throat plate to the thread catching portion of the first thread catching member disposed in the rearmost position, for example. It is possible to guide the thread caught by the first thread catching member to the thread catching portion of the second thread catching member through the backward movement of the first thread catching portion and causing the thread catching portion to catch the thread. By disposing the second thread catching member in a closer position to the needle hole, accordingly, it is possible to cut a portion of the thread laid between the thread catching portion of the first thread catching member and the needle hole which is closer to the needle hole.

According to the seventh aspect of the invention, the thread catching portion of the second thread catching member passes through a predetermined height in which the thread laid between the thread catching portion of the first thread catching member and the needle hole may be caught. Consequently, it is possible to enhance a reliability of the catching operation for catching the thread and the cutting operation for cutting the thread.

Other aspects and advantages of the invention will be apparent from the following description and the appended claims.

Figure 1:
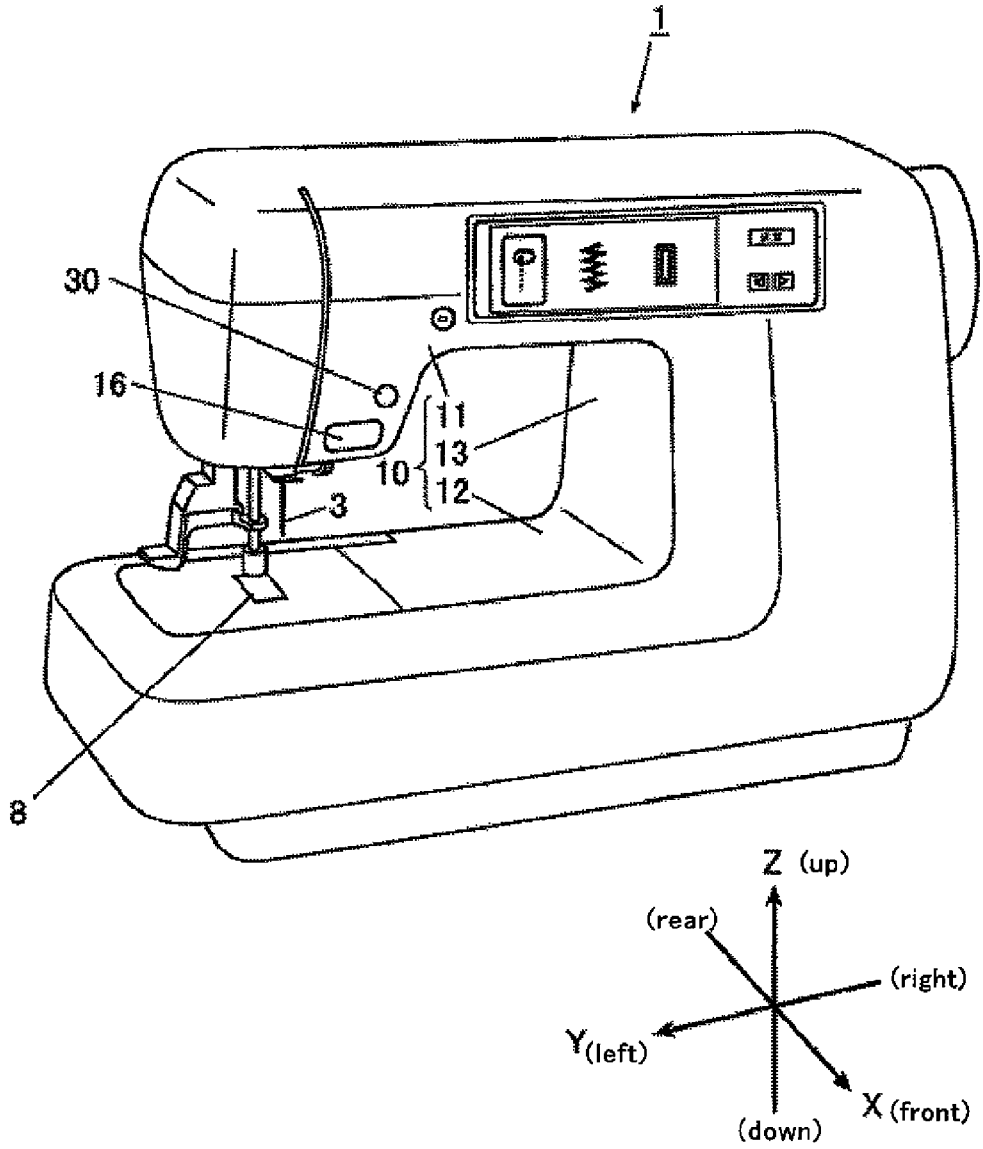
FIG. 1 is a schematic perspective view showing an appearance of a sewing machine according to the invention.

DESCRIPTION OF EXEMPLARY EMBODIMENTS (Whole Structure of Sewing Machine)

The best mode for carrying out the invention will be described below in detail with reference to FIGS. 1 to 18. Although various technical preferred restrictions for carrying out the invention are imposed on an embodiment which will be described below, the scope of the invention is not restricted to the following embodiment and examples shown in the drawings. In the embodiment, moreover, it is assumed that a direction of each portion in a sewing machine 1 (which will be described below) is defined based on X, Y and Z axes shown in the respective drawings. In a state in which the sewing machine 1 is disposed on a horizontal plane, a Z-axis direction indicates a vertical direction to be a perpendicular direction, a Y-axis direction indicates a transverse direction which is coincident with a longitudinal direction of an arm portion 11, and an X-axis direction indicates a longitudinal direction which is horizontal and is orthogonal to the Y-axis direction.

FIG. 1 is a schematic perspective view showing a whole structure of the sewing machine 1 mounting a thread cutting mechanism 100 (thread cutting device of sewing machine) to be a thread cutting device of a sewing machine according to the embodiment of the invention.

The sewing machine 1 is a domestic sewing machine which serves to oscillate a needle in an orthogonal direction to a predetermined cloth feeding direction while feeding the cloth at an optional feeding pitch in normal and reverse directions along the cloth feeding direction, and to carry out a needle location in an optional position with respect to a workpiece every stitch, thereby performing an optional pattern sewing work.

The sewing machine 1 comprises the thread cutting mechanism 100 (see FIGS. 2 and 3) to be a thread cutting device which serves to cut a thread T, a sewing machine frame 10 including the thread cutting mechanism 100, a needle driving mechanism (not shown) provided in the sewing machine frame 10 and serving to vertically drive a needle 3, a shuttle mechanism 20 (see FIG. 3) for forming a seam in cooperation with the needle driving mechanism, a sewing machine motor 5 (see FIG. 5) serving as a driving source for a vertical notion of the needle 3, an encoder 6 (see FIG. 9) for detecting a rotating amount of the sewing machine motor 5, a thread cutting button 30 (thread cutting start switch) to be a thread cutting start switch which serves to operate the thread cutting mechanism 100, a main shaft position detecting sensor 7 (see FIG. 9) for detecting a certain position (for example, an upper position) in one round of a main shaft to be rotated by the sewing machine motor 5, and a control portion 50 (Cutting control means) (see FIG. 9) for controlling an operation of the sewing machine motor 5. Each of the portions will be described below in detail.

The sewing machine 1 comprises a needle bar oscillating stepping motor 90 serving as a driving source for a needle oscillation, a feed dog driving stepping motor 91 serving as a driving source for feeding a cloth, a selecting pattern display unit 92 to be a liquid crystal panel which serves to display a sewing selected pattern, a start/stop switch 16 for inputting the start and stop of the sewing operation of the sewing machine 1, a pattern selecting switch 17 for selecting a sewing pattern, and a speed setting volume 18 to be speed setting means which serves to set a needle handling speed. Since they have the same structures as those of conventional well-known members, however, they will not be described in detail in the embodiment.

(Sewing Machine Frame)

As shown in FIG. 1, the sewing machine frame 10 includes the arm portion 11 forming an upper part of the sewing machine frame 10, a bed portion 12 forming a lower part of the sewing machine frame 10 and extended in parallel with the arm portion 11, and a vertical drum portion 13 coupling the arm portion 11 to the bed portion 12 and erected in a vertical direction (the Z-axis direction) which is orthogonal to a longitudinal direction of the arm portion 11 and the bed portion 12, and an external shape thereof is almost U-shaped as seen from a front.

An upper shaft (not shown) to be a main shaft is rotatably provided in the Y-axis direction to be a longitudinal direction in the arm portion 11, and the sewing machine motor 5 to be a main driving source of the operation of the sewing machine is coupled to the upper shaft. Moreover, the thread cutting button 30 for inputting the start of a thread cutting operation through the thread cutting mechanism 100 is provided on an end face at the operator side on a tip of the arm portion 11.

On the other hand, a lower shaft 2 coupled to the upper shaft through a pulley and a belt which are not shown is rotatably provided in the longitudinal direction of the bed portion 12 (the Y-axis direction) in the bed portion 12. When the upper shaft is rotated by the driving operation of the sewing machine motor 5, then, the lower shaft 2 is rotated by the pulley and the belt. In the embodiment, the lower shaft 2 is rotated at a one-to-one rotating speed with respect to the upper shaft, and a rotating angle of the upper shaft and that of the lower shaft correspond to each other. By detecting a predetermined rotating angle of the upper shaft, accordingly, it is possible to detect the rotating angle of the lower shaft which corresponds thereto. Moreover, a throat plate 8 having a needle hole 9 through which the needle 3 carries out the needle location is provided along an upper surface of the bed portion 12 at a tip side of the bed portion 12.

(Needle Driving Mechanism)

The needle driving mechanism which is not shown includes a rotating weight (not shown) fixed to a tip of the upper shaft in the tip of the arm portion 11, a crank rod (not shown) coupled rotatably to an eccentric portion of the rotating weight, a needle bar coupled to a lower end of the crank rod, and the needle 3 supported on a lower end of the needle bar. When the upper shaft is rotated by the driving operation of the sewing machine motor 5, the vertical motion of the needle bar is transmitted by the rotating weight and the crank rod so that the needle 3 carries out a reciprocally vertical motion.

(Shuttle Mechanism)

The shuttle mechanism 20 includes a horizontal shuttle 21 disposed in the vicinity of a stitch point of the needle 3 through the needle driving mechanism in an inner part at the tip side of the bed portion 12 and rotated around a shuttle shaft (not shown) which is provided vertically. The horizontal shuttle 21 includes an outer shuttle 22 to be rotated upon receipt of a power from the lower shaft 2 through a shuttle shaft gear which is not shown, and an inner shuttle 23 which is provided on an inside of the outer shuttle 22 and is not rotated. The outer shuttle 22 is rotated at a double rotating speed of the upper shaft and the lower shaft 2, that is, a double number of rotations and catches a loop of a needle thread T1 formed in the bed portion 12 in a lift of the needle 3 through a hook 25 provided on an outer periphery. A bobbin 24 upon which a bobbin thread T2 is wound is provided in the inner shuttle 23 exchangeably and rotatably. An upper part of the horizontal shaft 21 is released, and the bobbin thread T2 passed from the bobbin 24 is supplied along a bobbin thread path for the bobbin thread T2 and is entangled with the needle thread T1 so that a seam is formed.

(Thread Cutting Mechanism)

The thread cutting mechanism 100 will be described in detail with reference to FIGS. 2 to 9.

Figure 2:
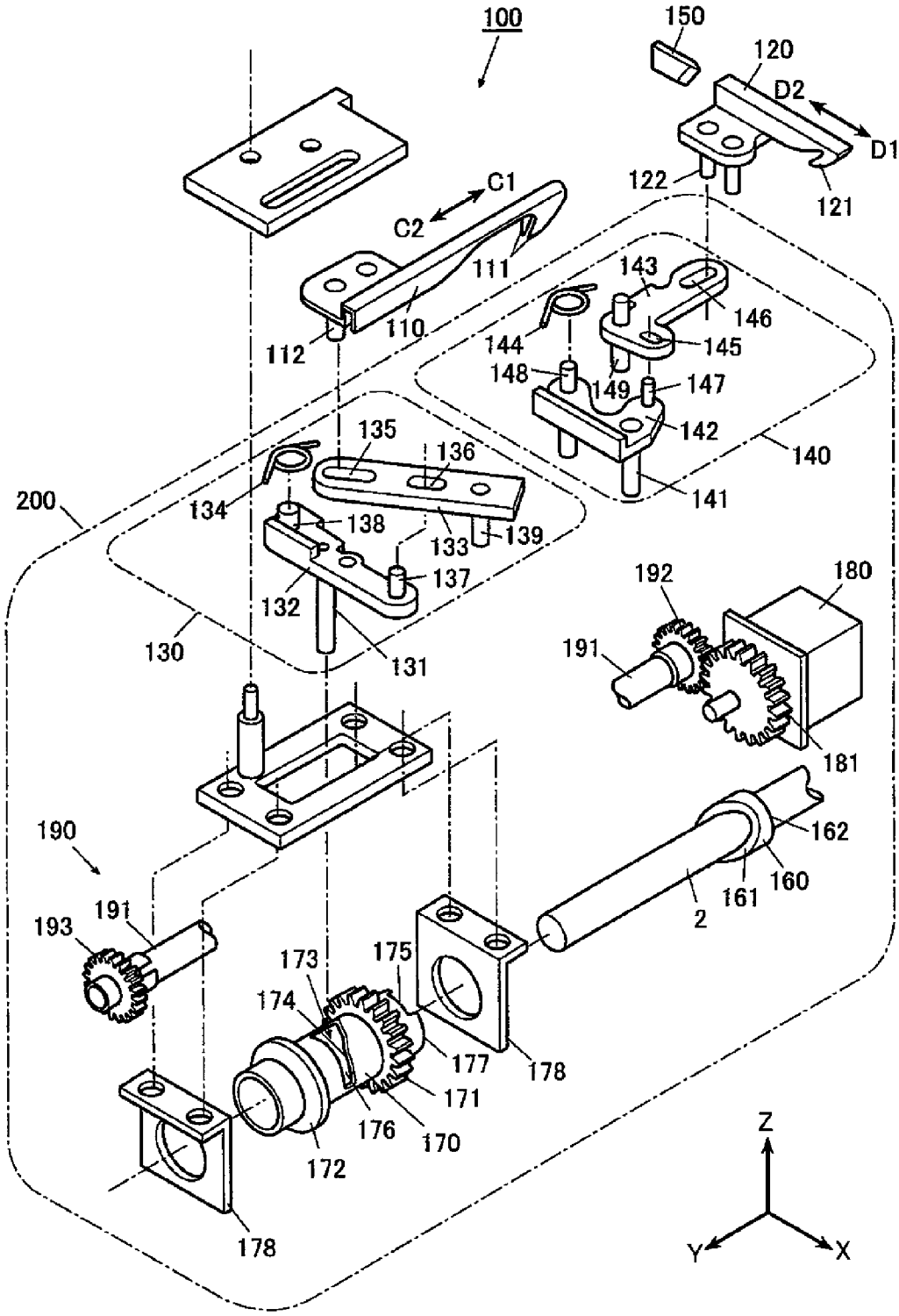
FIG. 2 is an exploded perspective view showing a structure of a thread cutting device.

FIG. 2 is an exploded perspective view showing a whole structure of the thread cutting mechanism 100. The thread cutting mechanism 100 is the cutting device of the sewing machine which serves to cut at least one of the needle thread T1 and the bobbin thread T2 which are laid between the horizontal shuttle 21 and the needle hole 9. A first thread catching body 110 (first thread catching member) has a thread catching portion 111 and is moved forward and backward below the throat plate 8 to catch the thread T. A second thread catching body 120 (second thread catching member) has a thread catching portion 121 and catches the thread T caught by the first thread catching body 110 and thus laid between the needle hole 9 and the thread catching portion 111, thereby guiding the thread T to a fixed blade 150 and cutting the thread T by the fixed blade 150. An operating device 200 for causing the second thread catching body 120 carries out the catching and cutting operations after the catching operation of the first thread catching body 110.

Figure 4A:
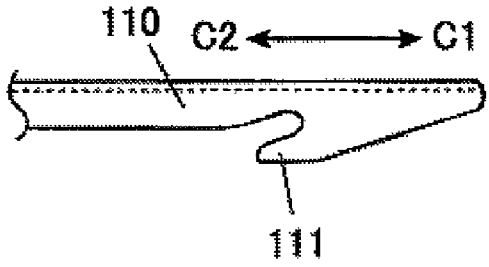
FIG. 4A is a schematic side view showing a first thread catching member.

As shown in FIG. 2 and FIG. 4A, the first thread catching body 110 includes the hook-shaped thread catching portion 111 which is a fold-back portion having a tip bent toward a rear side C2 for forward and backward movements, and serves to carry out the forward and backward movements (a reciprocal straight operation) in the longitudinal direction of the lower shaft 2 (the Y-axis direction) along a rail (not shown) through a first link mechanism 130 (first power transmitting member) of the operating device 200. Then, the first thread catching body 110 catches the needle thread T1 and the bobbin thread T2. Although the thread catching portion 111 is forked in the embodiment (see FIG. 2), a single hook may be used. Moreover, a clamp member (a thread holding member) which is not shown is provided on a side of the first thread catching body 110. The clamp member is caused to abut on a side surface of the thread catching portion 111 on the tip to hold the thread T subjected to cutting in a state in which the first thread catching body 110 is disposed in an initial condition, that is, a rearmost position (which will be described below).

Figure 18:
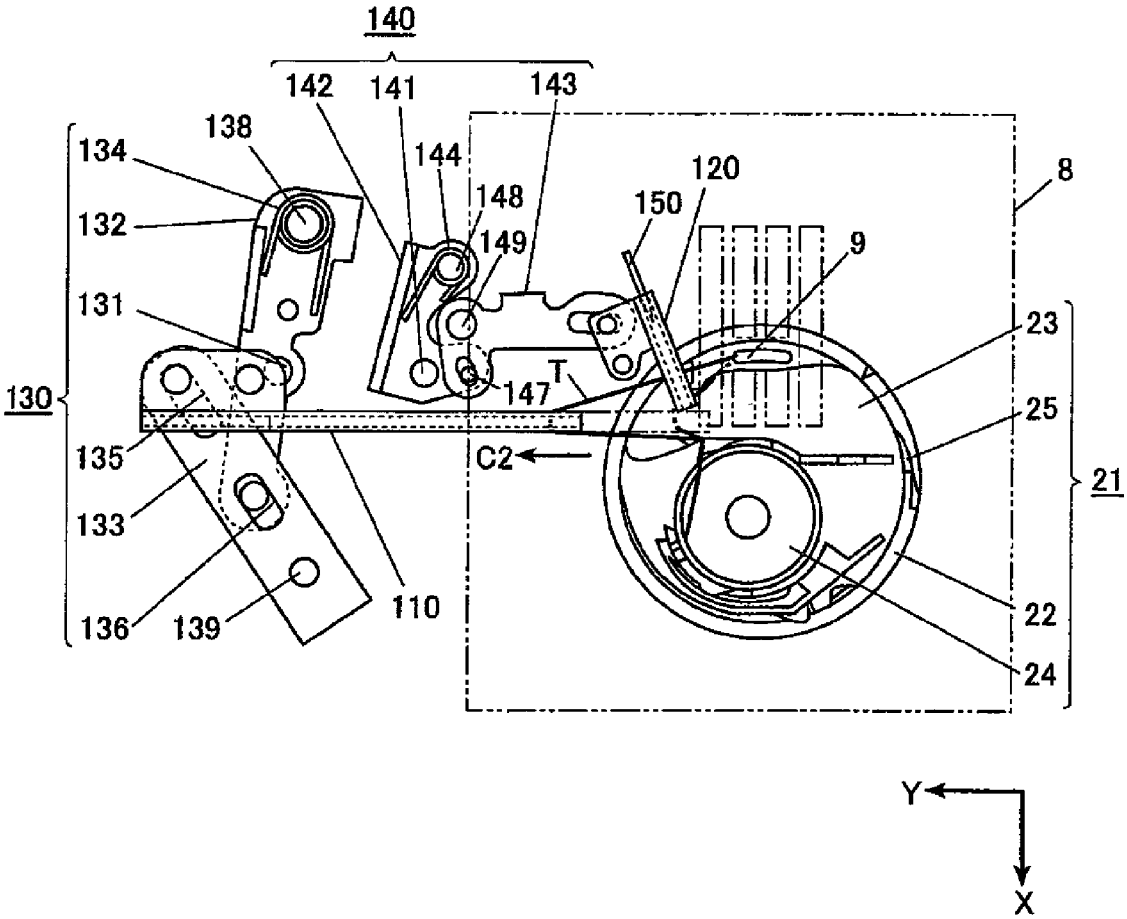
FIG. 18 is a view for explaining the operation of the thread cutting device.

In the same manner as the first thread catching body 110, the second thread catching body 120 has, at a tip, the hook-shaped thread catching portion 121 to be a fold back portion which is bent toward a rear side D2 for forward and backward movements, and serves to catch the thread T laid between the thread catching portion 111 of the first thread catching body 110 catching the bobbin thread T2 and the needle thread T1 and the needle hole 9 (see FIG. 18). The second thread catching body 120 is disposed in a position in the vicinity of a stitch point in which a reciprocal straight operation is given along a rail (not shown) through a second link mechanism 140 (second power transmitting member) of the operating device 200 which will be described below to carry out the forward and backward movements and the thread catching portion 121 provided on the tip may be thus operated to cross the thread T laid between the thread catching portion 111 of the first thread catching body 110 and the thread hole 9 as seen on a plane (see FIG. 18).

Figure 4B:
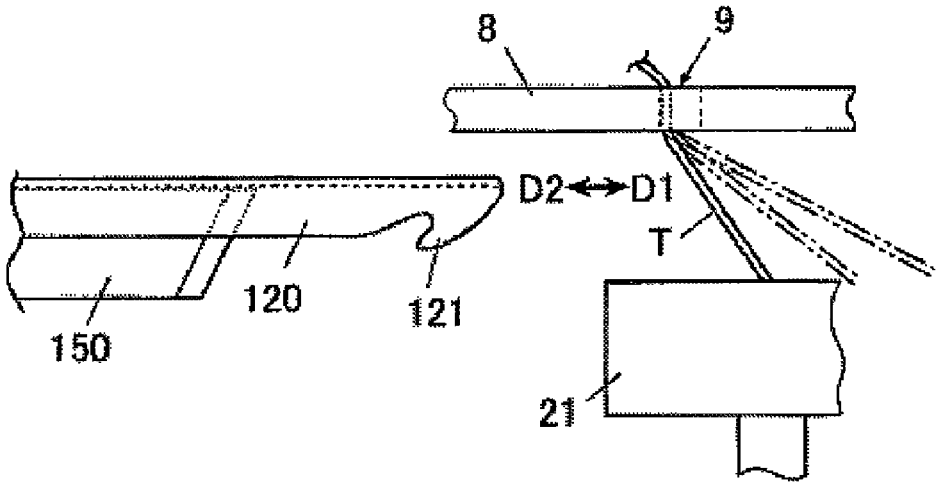
FIG. 4B is a schematic view showing a relationship between heights of a second thread catching member and a fixed blade, and a throat plate, a horizontal shuttle and a thread.

The second thread catching body 120 passes through a height (a predetermined height) in which the thread T laid between the thread catching portion 111 of the first thread catching body 110 and the needle hole 9 may be caught (see FIG. 4B). In other words, the second thread catching body 120 has a front end sharpened gradually toward an upper side which is close to the throat plate 8, and the front end is moved to pass between the thread T caught by the thread catching portion 111 of the first thread catching body 110 and the throat plate 8 as shown in FIG. 4B.

Figure 3:
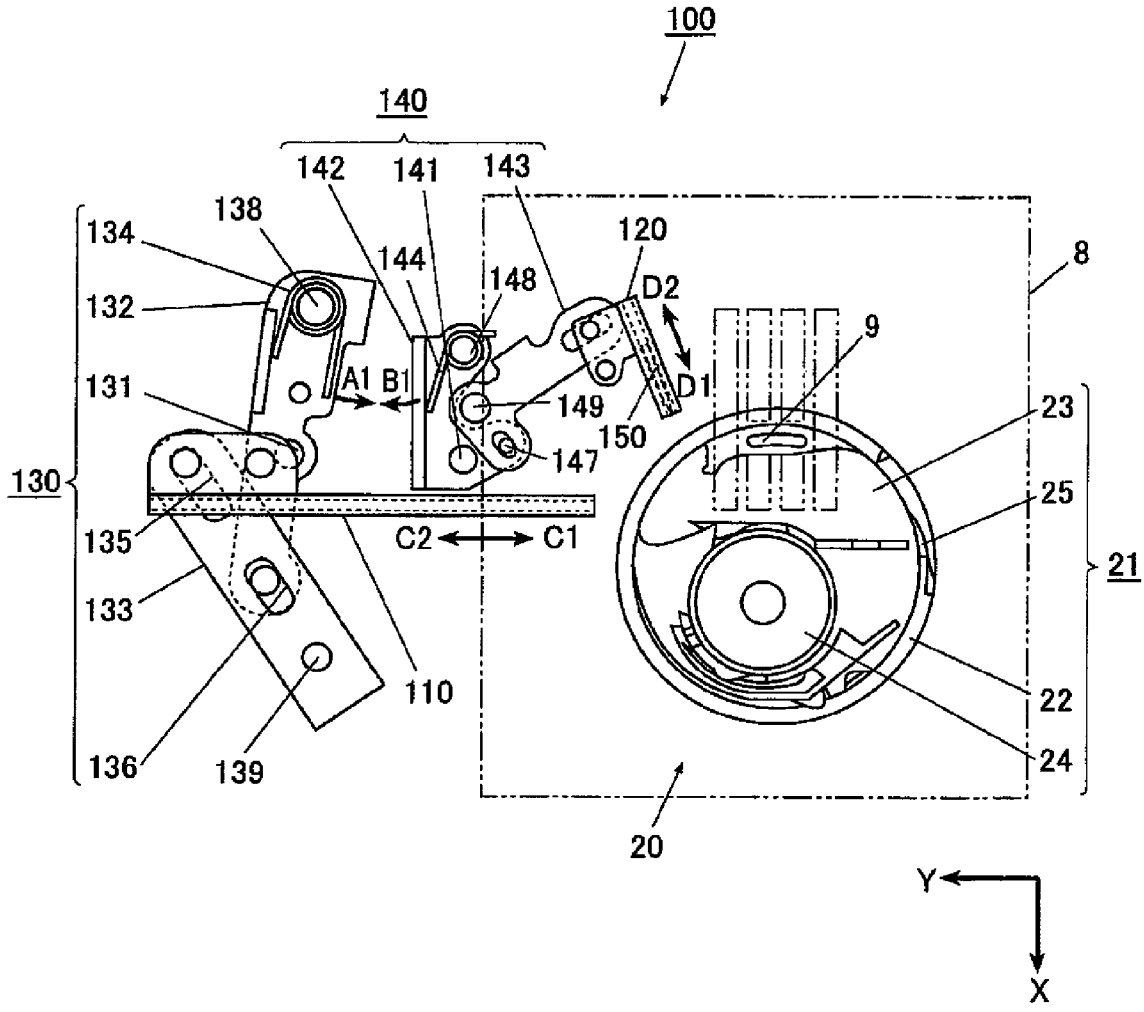
FIG. 3 is a plan view showing an arrangement of the thread cutting device.
Figure 4C:
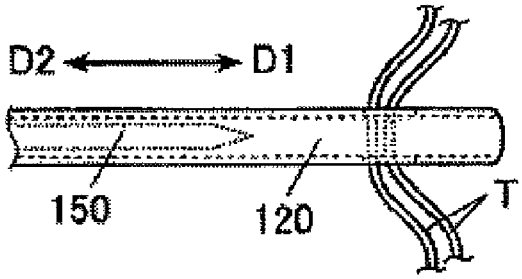
FIG. 4C is a plan view showing the second thread catching member and the fixed blade.

Moreover, the second thread catching body 120 is forked in a state in which a whole body in a longitudinal direction including the thread catching portion 121 on the tip is extended in parallel downward (see FIGS. 3 and 4C). The fixed blade 150 is provided on an inside of the forked portion toward a hook in a direction of the forward movement of the second thread catching body 120 (see FIGS. 4B and 4C). The second thread catching body 120 receives a power for the forward and backward movements through the operating device 200 and carries out the reciprocal straight operation along the fixed blade 150, thereby guiding the thread T caught by the thread catching portion 121 on the tip to the fixed blade 150, thereby cutting the thread T by the fixed blade 150.

As shown in FIG. 2, the operating device 200 includes a thread catching body driving stepping motor 180 (stepping motor) serving as a driving source for the catching operation of the first thread catching body 110 (which will be hereinafter referred to as a stepping motor 180), a thread cutting cam 160 (first cam member) which is provided on the lower shaft 2 to be rotated by the sewing machine motor 5, a thread catching body driving cam 170 (second cam member) which is provided side by side with the thread cutting cam 160 and is driven by the stepping motor 180, the first link mechanism 130 which has a cam abutting portion 131 to be a follower capable of abutting on drivers (driver portion) of both the thread cutting cam 160 and the thread catching body driving cam 170 and serves to transmit a power for the forward and backward movements from the thread cutting cam 160 and the thread catching body driving cam 170 to the first thread catching body 110, and the second link mechanism 140 to be the second power transmitting member which has a cam abutting portion 141 to be a follower capable of abutting on the drivers of both the thread cutting cam 160 and the thread catching body driving cam 170 and serves to transmit the power for the forward and backward movements from the thread cutting cam 160 and the thread catching body driving cam 170 to the second thread catching body 120.

Figure 5:
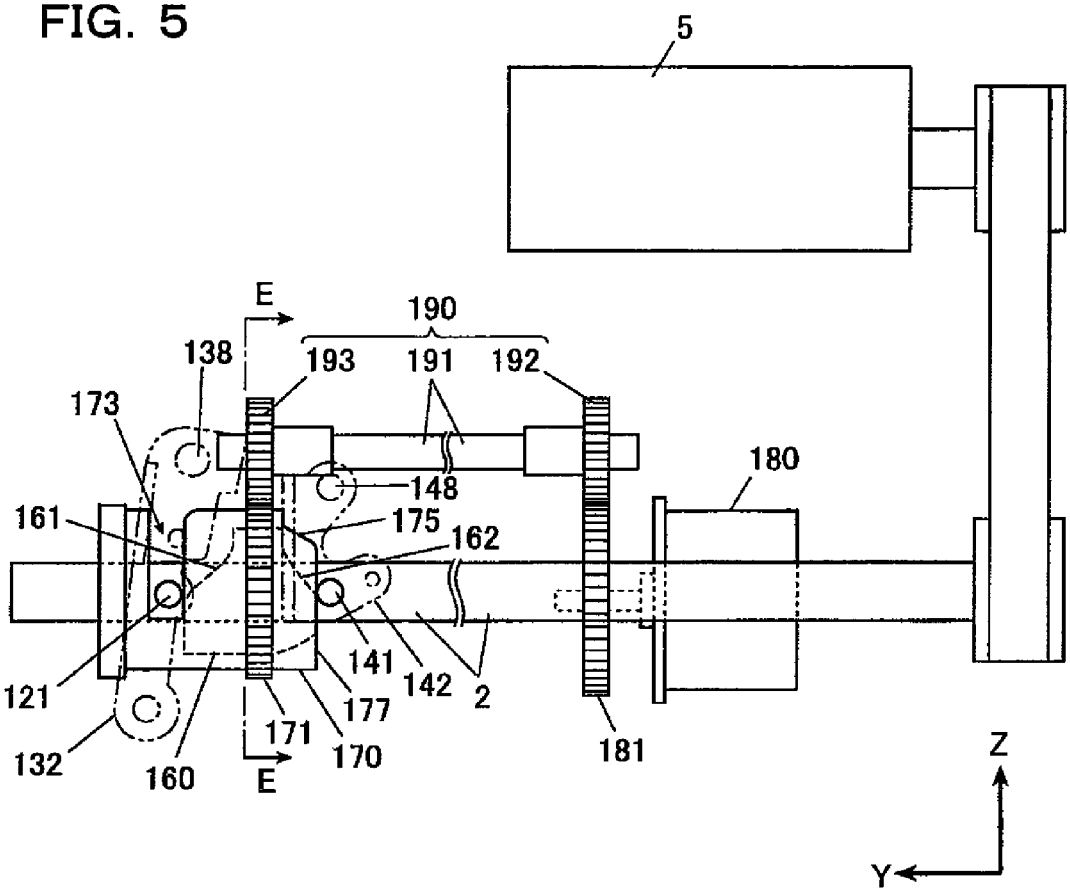
FIG. 5 is a schematic view showing a structure of a main part of the thread cutting device.
Figure 6:
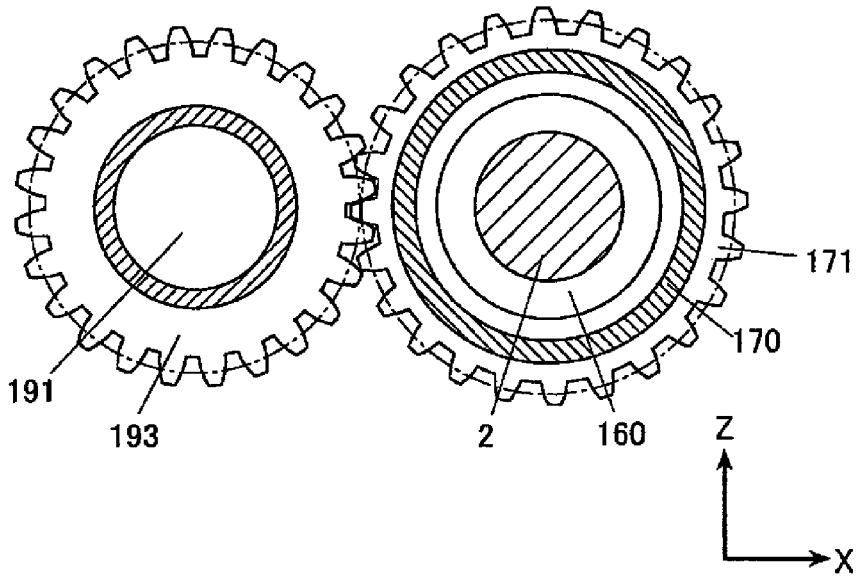
FIG. 6 is an end view showing an E-E section in FIG. 5.

As shown in FIGS. 2 and 5, the stepping motor 180 is positioned on the vertical drum portion 13 side (a right side in FIG. 5) in the bed portion 12 and has an output shaft disposed in the Y-axis direction. One of ends of a torque transmitting shaft 191 extended in parallel with the lower shaft 2 is coupled to the output shaft of the stepping motor 180 by gears 181 and 192, and a gear 193 is provided on the other end of the torque transmitting shaft 191. When the stepping motor 180 is driven, a rotating force is applied to the thread catching body driving cam 170 which will be described below by a power transmitting mechanism 190 constituted by the gears 181 and 192, the torque transmitting shaft 191 and the gear 193.

In the embodiment, a direction in which the thread catching body driving cam 170 to be described below is rotated in such a direction as to move the first thread catching body 110 and the second thread catching body 120 in C1 and D1 directions to be respective forward moving directions is set to be a normal rotating direction of the stepping motor 180. To the contrary, a direction in which the thread catching body driving cam 170 is rotated in such a direction as to move the first thread catching body 110 and the second thread catching body 120 in the C2 and D2 directions to be respective backward moving directions is set to be a reverse rotating direction of the stepping motor 180 (see FIG. 7). Referring to a driving amount of the stepping motor 180 which corresponds to an amount of an axial rotation in the thread catching body driving cam 170 for applying the forward and backward movements to the first thread catching body 110 through the first link mechanism 130 which will be described below and applying the forward and backward movements to the second thread catching body 120 through the second link mechanism 140 by the axial rotation, furthermore, the numbers of pulses corresponding to various forward and backward moving amounts are previously obtained experimentally and are stored in an ROM 52 to be a storing part of the control portion 50 which will be described below.

As shown in FIGS. 2 and 5, the thread cutting cam 160 is formed by an end cam which is fixed to the lower shaft 2 and is rotatable together with the lower shaft 2, and has drivers on both end faces in the axis direction of the lower shaft 2, that is, the Y-axis direction. One of the end faces which is an end (a left end in FIG. 5) an a backward side in the forward and backward movements of the first thread catching body 110, that is, a tip side of the bed portion 12 in the thread cutting cam 160 serves as an end cam portion 161 which is the driver of the thread cutting can 160 to be engaged with the cam abutting portion 131 (which will be described below) of the first link mechanism 130 to be the follower. In the embodiment, furthermore, the other end in the axis direction of the thread cutting cam 160 which is an end at the vertical drum portion 13 side in the bed portion 12 (a right end in FIG. 5) serves as an end cam portion 162 which is the driver of the thread cutting cam 160 to be engaged with the cam abutting portion 141 (which will be described below) of the second link mechanism 140 to be the follower.

In the thread cutting cam 160, the respective drivers guide the followers for them in order to move the first thread catching body 110 catching the thread T backward to a rearmost position while disposing the second thread catching body 120 in a foremost position and to then move the second thread catching body 120 to a rearmost position through the driving operation of the sewing machine motor 5.

Figure 8:
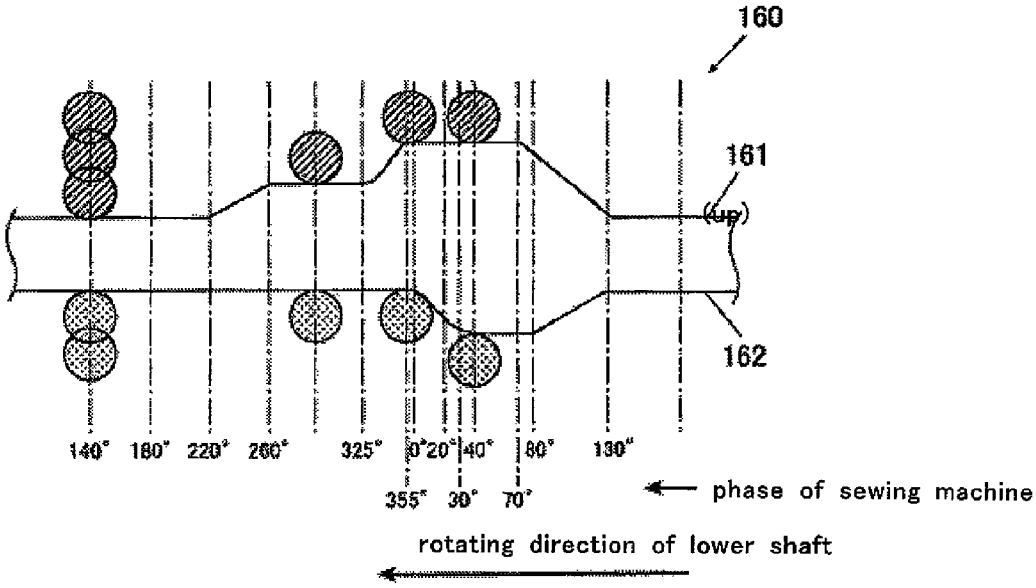
FIG. 8 is a developed view showing a shape of a thread catching member driving cam.

More specifically, the end cam portions 161 and 162 to be the respective drivers take shapes of end faces having a stepwise relief corresponding to a phase in a rotating direction in order to guide the followers 131 and 141 in predetermined timings and predetermined moving amounts depending on the rotating amount of the lower shaft 2 to be rotated by the driving operation of the sewing machine motor 5 by the control portion 50 serving as the cutting control means which will be described below (see FIG. 8).

As shown in FIGS. 2 and 5, the thread catching body driving cam 170 is a cylindrical cam in which an axial direction is provided along the Y-axis direction, and is concentric with the thread cutting cam 160 fixed to the lower shaft 2 and is disposed to retain the thread cutting cam 160 in an inner part. More specifically, the thread cutting cam 160 fixed to the lower shaft 2 is rotatably inserted together with the lower shaft 2 into the thread catching body driving cam 170 (see FIGS. 5 and 6).

A gear 171 and a flange 172 caused to abut on a support member 178 for rotatably supporting the thread catching body driving cam 170 to position the thread catching body driving cam 170 in the axis direction are provided in the vicinity of both ends in the axis direction in an outer peripheral part of the thread catching body driving can 170. The gear 171 serves as a driven gear for transmitting a rotating force from the stepping motor 180 to the thread catching body driving cam 170.

Figure 7:
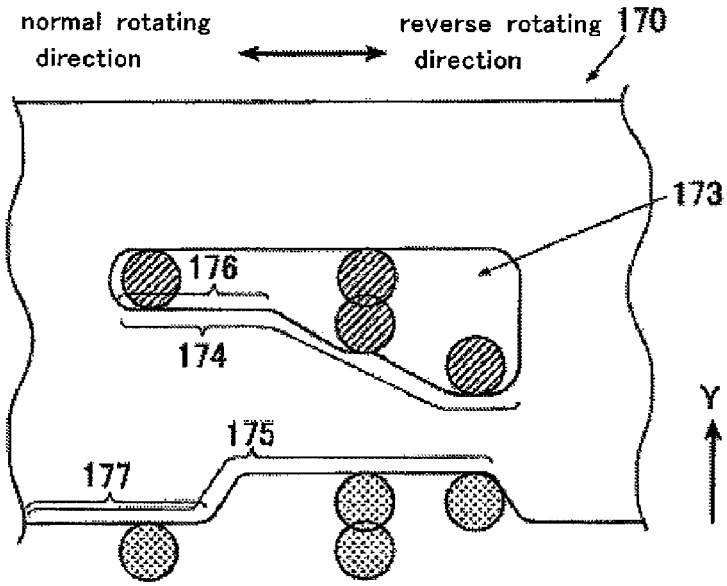
FIG. 7 is a developed view showing a shape of a thread cutting cam.

The thread catching body driving cam 170 is provided with an opening portion 173 penetrating through a peripheral surface portion of the thread catching body driving cam 170 from an inner periphery to an outer periphery. In the opening portion 173, an end face on the gear 171 side in the opening portion 173 (a lower side in FIG. 7) serves as a peripheral cam portion 174 having a slant portion which is enlarged and opened to be close to the gear 171 toward one end side in the circumferential direction of the thread catching body driving cam 170, that is, a reverse rotating direction side in the rotating operation of the stepping motor 180 (a right side in FIG. 7) and is formed obliquely to the X-axis direction and the Y-axis direction as shown in FIG. 7.

Through the rotation of the thread catching body driving cam 170 around the Y-axis, the peripheral cam portion 174 moves the cam abutting portion 131 to abut on the peripheral cam portion 174 in the Y-axis direction by an energizing force of a spring 134 (energizing means) which will be described below. A standby portion 176 formed in a circumferential direction which is orthogonal to the axis direction of the thread catching body driving cam 170 is provided on one end at the flange 172 side in the peripheral cam portion 174, that is, a normal rotating direction side of the rotating operation through the stepping motor 180 (a left side in FIG. 7).

The standby portion 176 disposes the first thread catching body 110 in a standby position (see FIG. 11B) to be a rearmost position in the forward and backward movements when the cam abutting portion 131 of the first link mechanism 130 which will be described below is engaged with the standby portion 176. More specifically, the standby portion 176 functions as an abutting portion according to the invention which moves the first thread catching body 110 backward and moves and holds the cam abutting portion 131 into a position in which the end cam portion 161 to be the driver of the thread cutting cam 160 is not engaged with the cam abutting portion 131 of the first link mechanism 130 to be the follower. In other words, when the cam abutting portion 131 is held in the standby portion 176 and the first thread catching body 110 is disposed in the standby position see FIG. 11B), the lower shaft 2 and the thread cutting cam 160 may be freely rotated without a hindrance.

On the other hand, in the same manner as the peripheral cam portion 174, an end cam portion 175 also functions as the abutting portion according to the invention which moves the second thread catching body 120 to a rearmost position through the second link mechanism 140, thereby moving and holding the cam abutting portion 141 into a position in which the end cam portion 162 to be the driver of the thread cutting cam 160 is not engaged with the cam abutting portion 241 to be the follower. In other words, when the cam abutting portion 141 is held in a standby portion 177 formed in a circumferential direction orthogonally to the axis direction and the second thread catching body 120 is disposed in the standby position (see FIG. 11B), the cam abutting portion 141 does not abut on the thread cutting cam 170 and is not engaged therewith (see FIG. 11A) so that the lower shaft 2 and the thread cutting cam 160 may be freely rotated without a hindrance.

In other words, the thread catching body driving cam 170 takes such a shape that the peripheral cam portion 174 and the end cam portion 175 which are the drivers move the first thread catching body 110 and the second thread catching body 120 backward, and moves and holds the respective cam abutting portions 131 and 141 in a position in which the driver of the thread cutting cam 160 is engaged with neither of the cam abutting portions 131 and 141.

The thread catching body driving cam 170 guides the respective cam abutting portions 131 and 141 in such a manner that the peripheral cam portion 174 and the end cam portion 175 which are the drivers move both the first thread catching body 110 and the second thread catching body 120 from the rearmost position to the foremost position through the normal rotation of the stepping motor 180, and then disposes the first thread catching body 110 in a thread catching position in the middle of the rearward movement while maintaining the second thread catching body 120 to be disposed in the foremost position through the reverse rotation of the stepping motor 180 (see FIG. 7).

As shown in FIGS. 2 and 3, the first link mechanism 130 includes a link 132 having one of ends supported rotatably on a base (not shown) which is fixed into the bed portion 12, a link 133 which is rotatably coupled to the other end of the link 132, and the spring 134 for always energizing the link 132 in one of turning directions.

The link 132 has one of ends which is supported on a turning shaft 138 (rotating fulcrum) with the Z-axis direction set to be an axial center on the side of the thread catching body driving cam 170, and the other end extended in a horizontal direction to pass above the thread catching body driving cam 170 and provided to be horizontally turnable with the turning shaft 138 set to be a rotating fulcrum. The bar-shaped cam abutting portion 131 extended downward is provided in an almost central part in a longitudinal direction of the link 132. The cam abutting portion 131 has a lower end inserted into the opening portion 173 of the thread catching body driving cam 170 and functions as the follower according to the invention which may abut on both the peripheral cam portion 174 to be the driver of the thread catching body driving cam 170 and the end cam portion 161 to be the driver of the thread cutting cam 160. Moreover, a pin 137 is protruded upward from the other end of the link 132.

The link 133 has a slot 136 penetrating through an almost central part in a longitudinal direction thereof along the Z-axis direction and formed in the longitudinal direction, and is rotatably coupled to the link 132 through the pin 137 fitted slidably in the slot 136. In the link 133, one of ends at a reverse side to the turning shaft 138 of the link 132 with a coupling portion to the link 132 interposed therebetween is rotatably supported on the base (not shown) fixed into the bed portion 12 with a turning shaft 139 in the Z-axis direction set to be a rotating fulcrum, and is provided to be horizontally turnable. Moreover, the other end of the link 133 is provided with a slot 135 penetrating through the link 133 in the Z-axis direction along the longitudinal direction, and a pin 112 provided in a lower part of the first thread catching body 110 is fitted slidably in the slot 135.

The spring 134 always energizes the link 132 to be rotated in a direction of an arrow A1 shown in FIG. 3 and always energizes the cam abutting portion 131 provided on the lower end of the link 132 toward the peripheral cam portion 174 and end cam portion 161 sides so that the first thread catching body 110 coupled to the link 132 through the link 133 is always energized in a rightward direction shown in FIG. 3, that is, the forward moving direction C1.

The first link mechanism 130 always transmits a moving force in the forward moving direction C1 (the rightward direction in FIGS. 3 and 5) to the first thread catching member 110 by the energizing force of the spring 134 and transmits a moving force in the backward moving direction C2 (a left side in FIGS. 3 and 5) to the first thread catching body 110 when the thread cutting cam 160 or the thread catching body driving cam 170 is rotated so that the cam abutting portion 131 is moved to a tip side of the bed portion 12 (the same left side) against the energizing force of the spring 134.

As shown in FIGS. 2 and 3, the second link mechanism 140 includes a link 142 having one of ends supported pivotally to be horizontally turnable in a closer position to the stitch point than the first link mechanism 130, a link 143 coupled to the other end of the link 142, and a spring 144 for always energizing the link 142 in a turning direction B1.

The link 142 is an almost L-shaped link member and has one of ends supported to be horizontally turnable with a turning shaft 148 in the Z-axis direction set to be a rotating fulcrum. The other end of the link 142 is extended horizontally to an upper part of the lower shaft 2 and is provided to be horizontally turnable (see FIG. 5). A pin 147 is protruded upward on the other end of the link 142. Moreover, the bar-shaped cam abutting portion 141 extended downward is provided on the other end. The cam abutting portion 141 has a lower end extended to the vicinity of the lower shaft 2 and functions as the follower according to the invention which may abut on both the end cam portion 175 to be the driver of the thread catching body driving cam 170 and the end cam portion 162 to be the driver of the thread cutting can 160.

The link 143 is an almost L-shaped link member and is supported to be horizontally turnable with a turning shaft 149 in the Z-axis direction set to be a rotating fulcrum in the L-shaped bent portion. One of ends at a short side of the link 143 is provided with a slot 145 in a radial direction around the turning shaft 149 which penetrates in the Z-axis direction, and the links 142 and 143 are rotatably coupled to each other through the pin 147 inserted slidably into the slot 145. Moreover, the other end on a long side of the link 143 is provided with a slot 146 in the radial direction around the turning shaft 149 which penetrates in the Z-axis direction, and a pin 122 provided in a lower part of the second thread catching body 120 is slidably fitted in the slot 146.

The spring 144 always energizes the link 142 to be rotated in the direction of the arrow B1 shown in FIG. 3 so that the cam abutting portion 141 provided on the lower end of the link 142 is always energized toward the end cam portion 175 and end cam portion 162 side and the second thread catching body 120 coupled to the link 142 through the link 143 is always energized in the direction of the arrow D1 shown in FIG. 3, that is, the forward moving direction.

The second link mechanism 140 always transmits a moving force in the forward moving direction (the direction of the arrow D1 shown in FIG. 3) to the second thread catching body 120 by an energizing force of the spring 144 and transmits a moving force in the backward moving direction (the direction of the arrow D2 shown in FIG. 3) to the second thread catching body 120 when the cam abutting portion 141 is moved to the vertical drum portion 13 side (the rightward direction in FIGS. 3 and 5) against the energizing force of the spring 144 through the rotation of the thread cutting cam 160 or the thread catching body driving cam 170.

(Control System of Sewing Machine)

Next, a structure of a control system of the sewing machine 1 will be described in detail with reference to FIG. 9.

Figure 9:
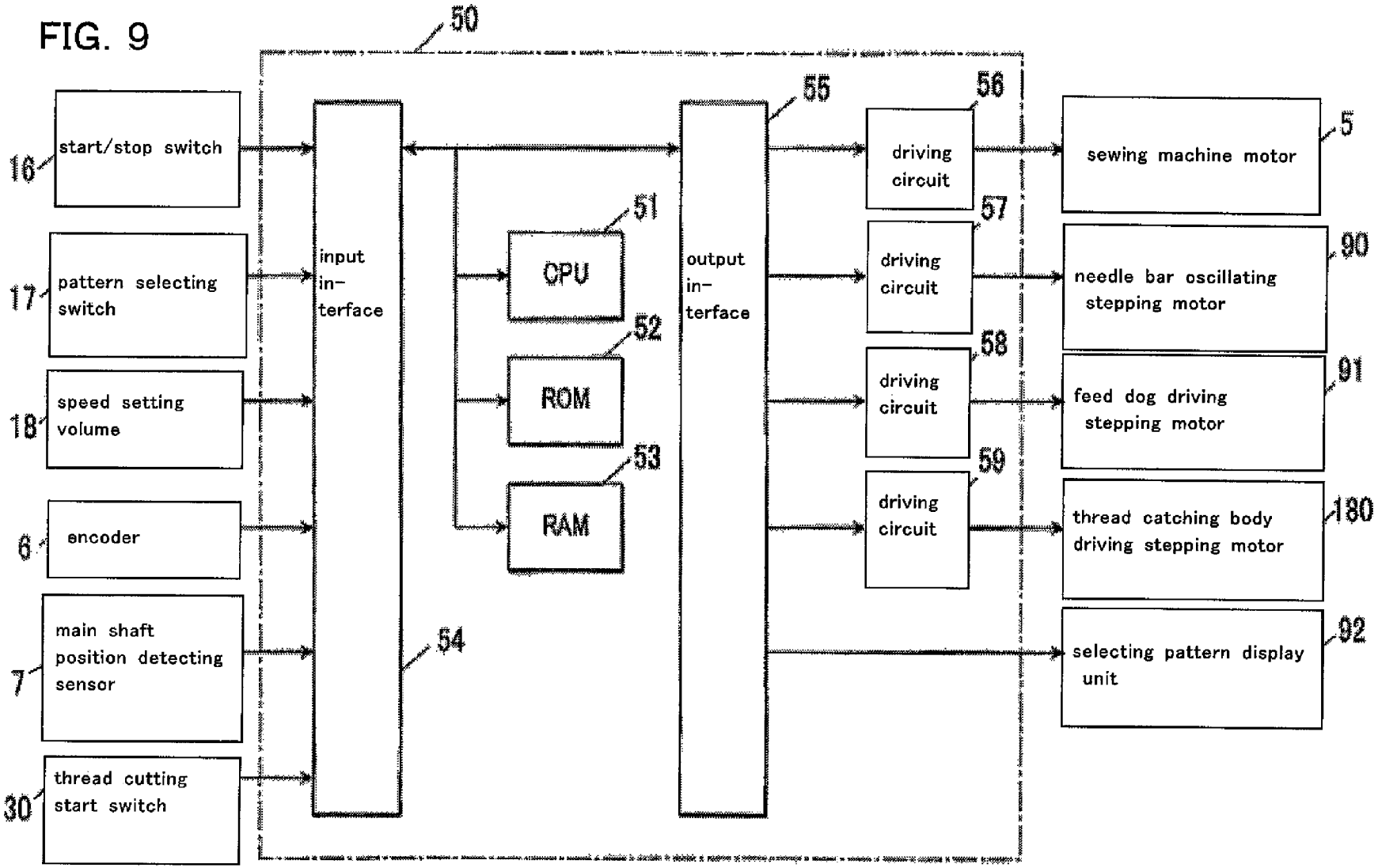
FIG. 9 is a control block diagram showing an electrical structure.

FIG. 9 is a control block diagram showing an electrical structure of the sewing machine 1 according to the invention. As shown in FIG. 9, the control portion 50 includes the ROM 52 for storing various programs to carry cut various controls and processings which will be described below, sewing data for carrying out various pattern sewing operations, and other various set data, a CPU 51 for executing various programs in the ROM 52, an RAM 53 serving as a work area in an execution of the various programs, an input interface 54 and an output interface 55 which are connected to the CPU 51, the ROM 52 and the RAM 53 through buses, a switching driving circuit 56 for carrying out a driving operation through a supply of a power to the sewing machine motor 5, a driving circuit 57 for carrying out a driving operation through a supply of a power to the needle bar oscillating stepping motor 90, a driving circuit 58 for carrying out a driving operation through a supply of a power to the feed dog driving stepping motor 91, and a driving circuit 59 for carrying out a driving operation through a supply of a power to the thread catching body driving stepping motor 180.

The input interface 54 transmits signals input from the start/stop switch 16, the pattern selecting switch 17, the speed setting volume 18, the encoder 6 and the main shaft position detecting sensor 7 to the CPU 51, and the output interface 55 carries out a predetermined control operation over the driving circuits 56, 57 and 58 and the selecting pattern display unit 92 in accordance with a command of the CPU 51.

The encoder 6 is constituted by a disk (not shown) which is attached to the rotating shaft of the sewing machine motor 5 and an optical sensor. The disk has a slit formed at a regular interval along a circumference, and the optical sensor includes a light source and a light receiving device which are disposed with the disk interposed therebetween. When the upper shaft which is not shown carries out a rotation, a pulse signal is generated from the light receiving device through a repetition of a transmission and a cutoff of a light emitted from the light source. The encoder 6 is designed in such a manner that the optical sensor generates 180 pulses per rotation of the upper shaft. A pulse signal output from the encoder 6 is input to a pulse counter of the input interface 54.

The control portion 50 executes a control processing in which the CPU 51 carries out a calculation processing by using the RAM 53 as the work area based on the various control programs stored in the ROM 52 in response to signals input from the start/stop switch 16, the pattern selecting switch 17, the speed setting volume 18, the encoder 6 and the main shaft position detecting sensor 7, and signals output corresponding to a result of the calculation are sent to various actuators such as the sewing machine motor 5, the needle bar oscillating stepping motor 90 and the feed dog driving stepping motor 91 to drive the respective actuators, thereby carrying out a predetermined sewing work.

Furthermore, the control portion 50 according to the embodiment functions as cutting control means in accordance with the invention for driving the stepping motor 180 to move the first thread catching body 110, thereby catching the tread T, and then driving the sewing machine motor 5 to move the second thread catching body 120, thereby cutting the thread T.

More specifically, when the press-down of the thread cutting button 30 to be the thread cutting start switch is detected, the control portion 50 serves as the cutting control means to execute a control in which the CPU 51 reads a detection signal of the main shaft position detecting sensor 7, and drives the stepping motor 180 in a normal rotating direction when the lower shaft 2 is positioned at a predetermined rotating angle (for example, an angle of the lower shaft in the case in which the needle bar is stopped below) to move both the first thread catching body 110 and the second thread catching body 120 from the rearmost position to the foremost position and then drives the stepping motor 180 in a reverse rotating direction to dispose the first thread catching body 110 in the thread catching position in the middle of the backward movement while disposing the second thread catching body 120 in the foremost position. The control is carried out by causing the CPU 51 to drive the stepping motor 180 in order to rotate the thread catching body driving cam 170 axially in a predetermined amount corresponding to shapes (see FIG. 7) of the respective cams of the peripheral cam portion 174 and the end cam portion 175 formed in predetermined phases in the circumferential direction of the thread catching body driving cam 170.

Moreover, the control portion 50 serves as the cutting control means to execute the control for driving the stepping motor 180 in the reverse rotating direction to dispose the first thread catching body 110 in the thread catching position while disposing the second thread catching body 120 in the foremost position and to then execute a control for stopping the stepping motor 180 and driving the sewing machine motor 5, thereby moving the first thread catching body 110 catching the thread T to the rearmost position while disposing the second thread catching body 120 in the foremost position and then moving the second thread catching body 120 to the rearmost position.

(Explanation of Operation According to the Embodiment)

Figure 10:
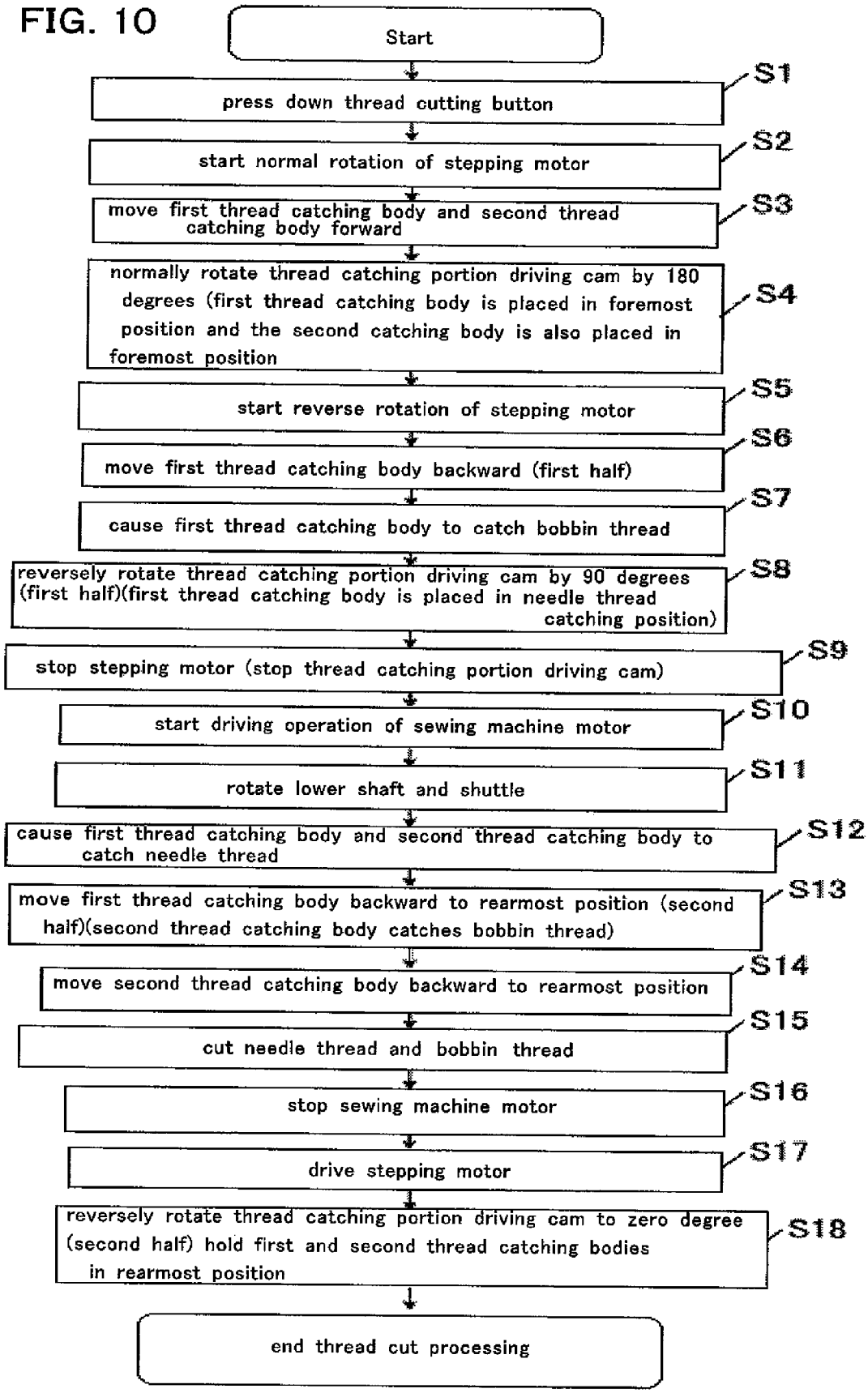
FIG. 10 is a flowchart showing an operation of the thread cutting device.

Next, an operation of the sewing machine 1 having the structure will be described based on a flowchart shown in FIG. 10.

Figure 11A:
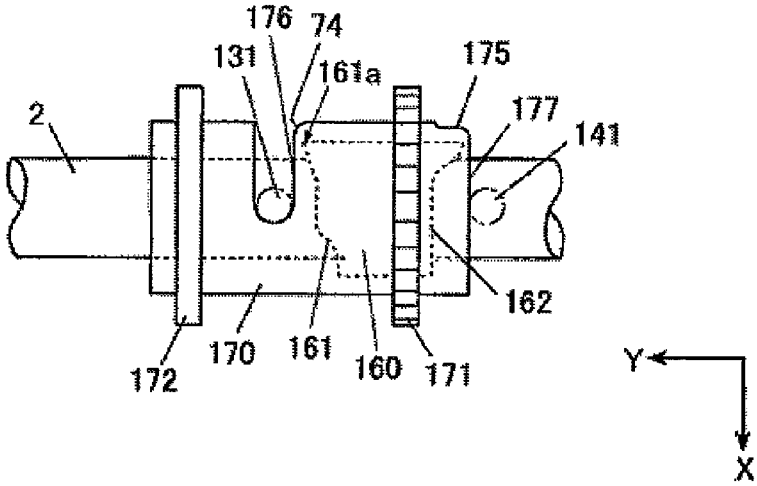
FIG. 11A is a view for explaining the operation of the thread catching body driving cam.
Figure 11B:
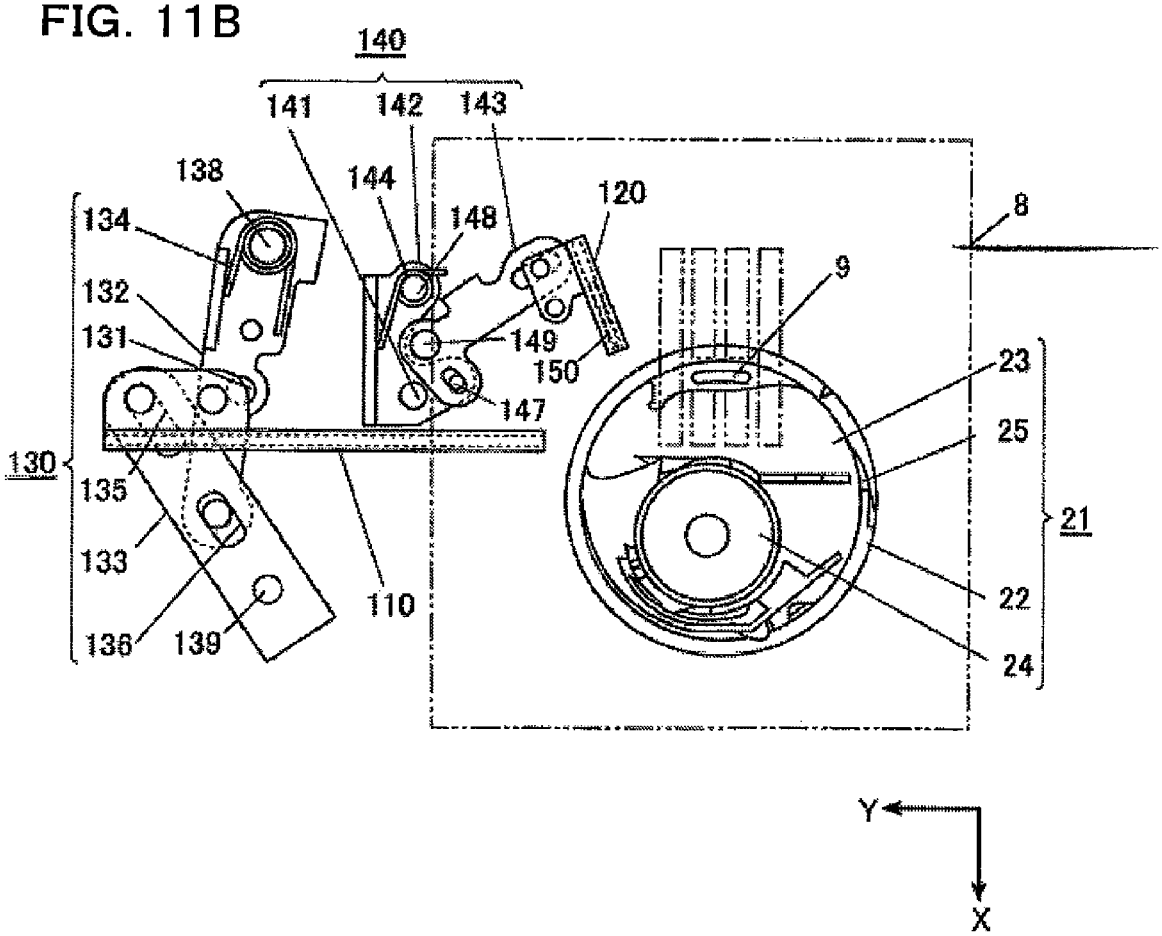
FIG. 11B is a view for explaining the operation of the thread cutting device.

First of all, during a sewing work, the cam abutting portion 131 of the first link mechanism 130 is held to be disposed in the standby portion 176 of the peripheral cam portion 174 in the thread catching body driving cam 170, and furthermore, the cam abutting portion 141 of the second link mechanism 140 is held to be disposed in the standby portion 177 of the end cam portion 175 in the thread catching body driving can 170 as shown in FIG. 11A. For this reason, the respective cam abutting portions 131 and 141 and the thread cutting cam 160 are prevented from interfering with each other, and the lower shaft 2 and the thread cutting can 160 may be rotated freely. Moreover, the first thread catching body 110 and the second thread catching body 120 standby in a disposing state in the rearmost positions in the respective forward and backward moving directions, that is, the standby positions as shown in FIG. 11B.

Figure 12A:
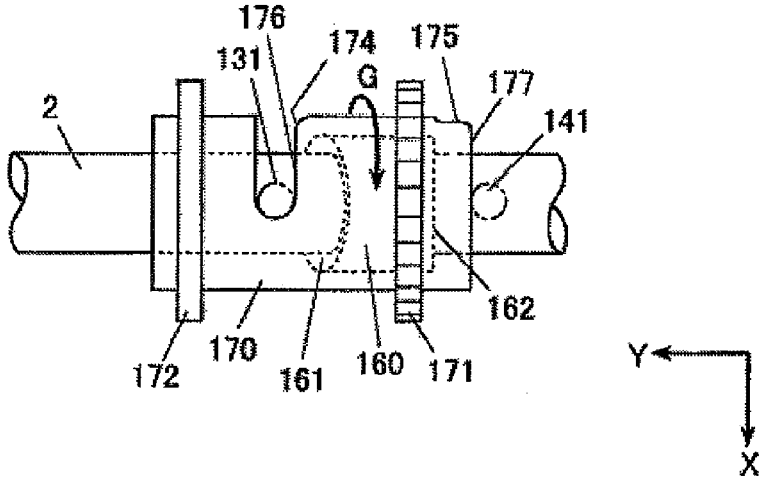
FIG. 12A is a view for explaining the operation of the thread catching body driving cam.
Figure 12B:
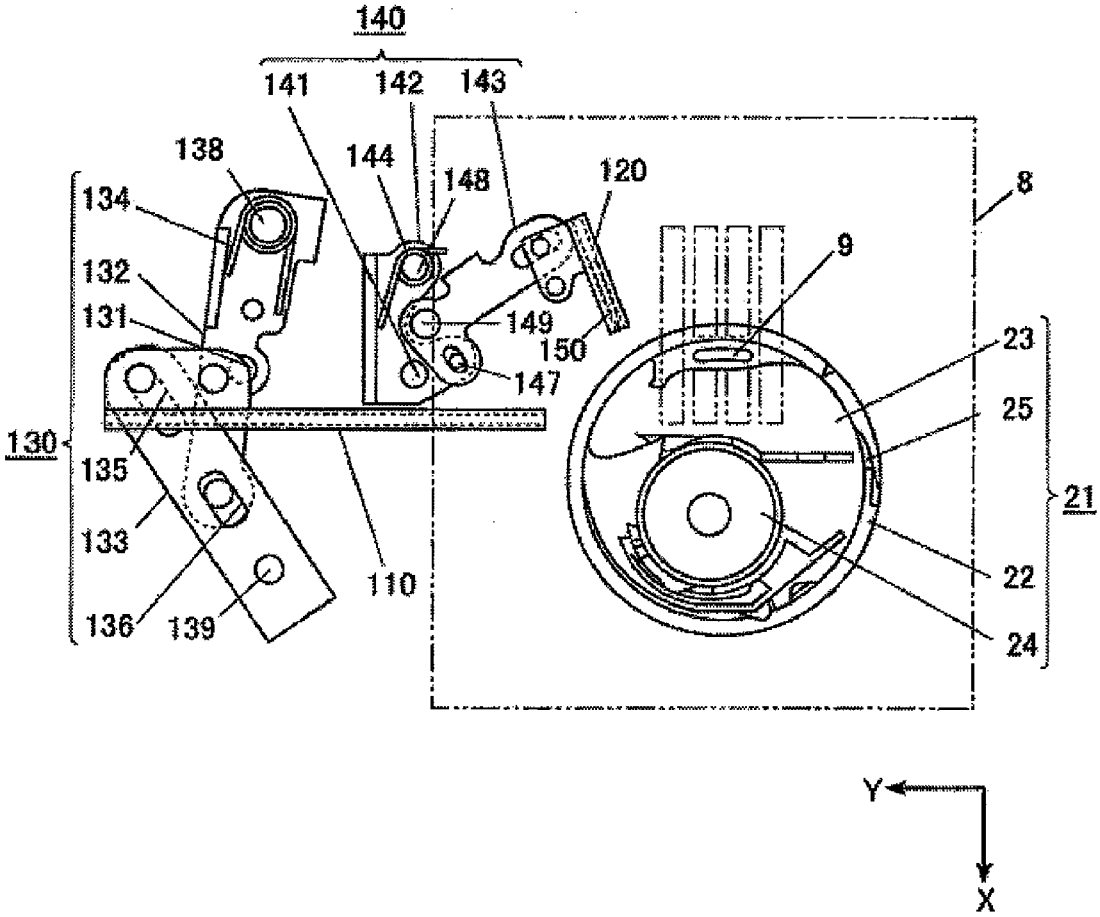
FIG. 12B is a view for explaining the operation of the thread cutting device.

When the sewing work is ended, next, the sewing machine motor 5 is stopped so that the upper shaft and the lower shaft 2 are stopped in a state in which the needled 3 is stopped below. At this time, a tip 161*a* of the end cam portion 161 is disposed on a reverse side to the cam abutting portion 131, that is, a lower side with the axis of the lower shaft 2 interposed therebetween and the thread cutting cam 160 is thus stopped as shown in FIG. 12A. Consequently, a space capable of moving the cam abutting portions 131 and 141 is maintained in order to move the first thread catching body 110 and the second thread catching body 120 to the foremost positions respectively when the thread catching body driving cam 170 is driven. As shown in FIG. 12B, moreover, the first thread catching body 110 and the second thread catching body 120 still stand by in the disposing state in the standby positions respectively in this stage.

When the thread cutting button 30 is pressed down by the operator so that a start signal for a thread cutting operation is detected (Step S1), subsequently, the CPU 51 drives the stepping motor 180 in the normal rotating direction through the driving circuit 59 (Step S2) to execute a processing of rotating the thread catching body driving cam 170 in a circumferential direction of an arrow G shown in FIG. 12A). Consequently, the cam abutting portion 131 abutting on the peripheral can portion 174 is moved in the rightward direction in FIGS. 12A and 12B along the peripheral cam portion 174 by the energizing force of the spring 134 so that the link 132 is turned in such a direction as to forward move the first thread catching body 110 (the direction of the arrow A1) around the rotating fulcrum 138. Consequently, the first thread catching body 110 is moved in the forward moving direction C1 (Step S3). By the rotation of the thread catching body driving cam 170, moreover, the cam abutting portion 141 abutting on the end cam portion 175 is moved in the leftward direction in FIGS. 12A and 12B along the end cam portion 175 by the energizing force of the spring 144. Consequently, the link 142 is turned in the direction of the arrow B1 around the rotating fulcrum 148 so that the second thread catching body 120 is moved in the forward moving direction D1 (Step S3).

Figure 13A:
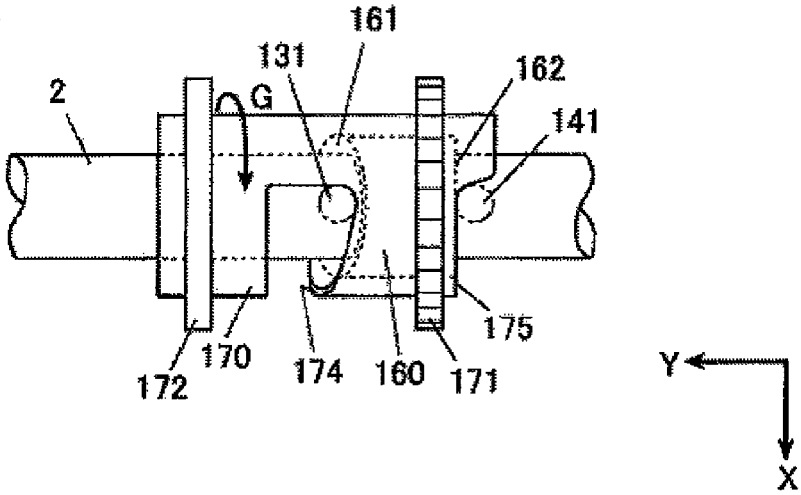
FIG. 13A is a view for explaining the operation of the thread catching body driving cam.
Figure 13B:
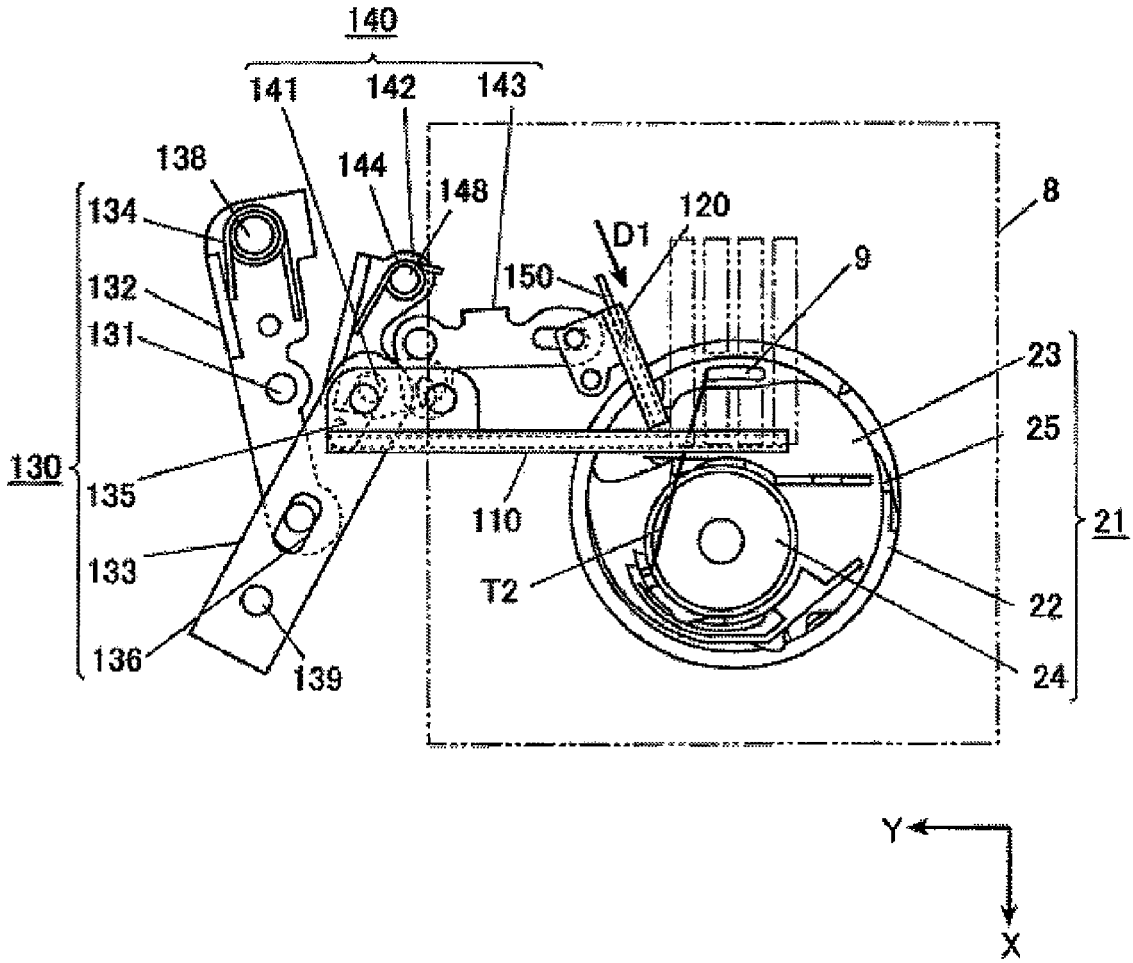
FIG. 13B is a view for explaining the operation of the thread cutting device.

When the stepping motor 180 is driven until the thread catching body driving cam 170 is rotated by 180 degrees from an initial position in the direction of the arrow G as shown in FIG. 13A (Step S4), the first thread catching body 110 is moved to the foremost position to cause the thread catching portion 111 to pass through the bobbin thread path for the bobbin thread T2 laid between the bobbin 24 and the needle hole 9 below the throat plate 8 as shown in FIG. 13B. Through the rotation of the thread catching body driving cam 170, moreover, the thread catching portion 121 provided on the tip of the second thread catching body 120 is moved to the foremost position in the vicinity of the stitch point which is close to the first thread catching body 110 above the horizontal shuttle 21 (see FIG. 13B).

Figure 14A:
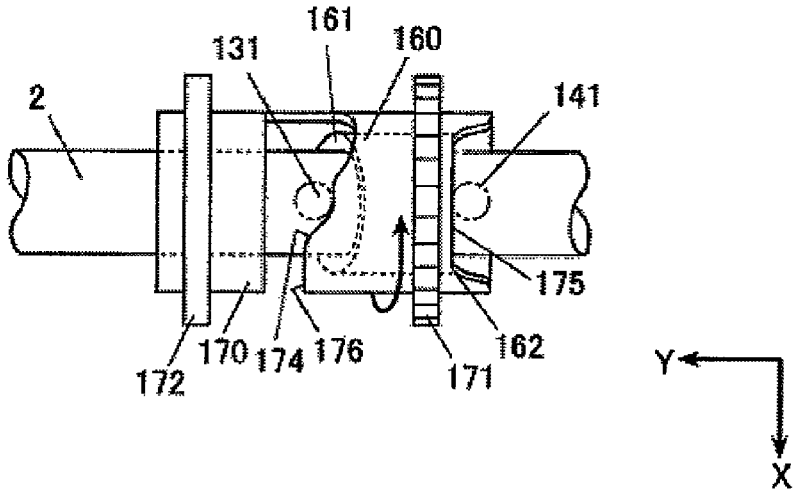
FIG. 14A is a view for explaining the operation of the thread catching body driving cam.
Figure 14B:
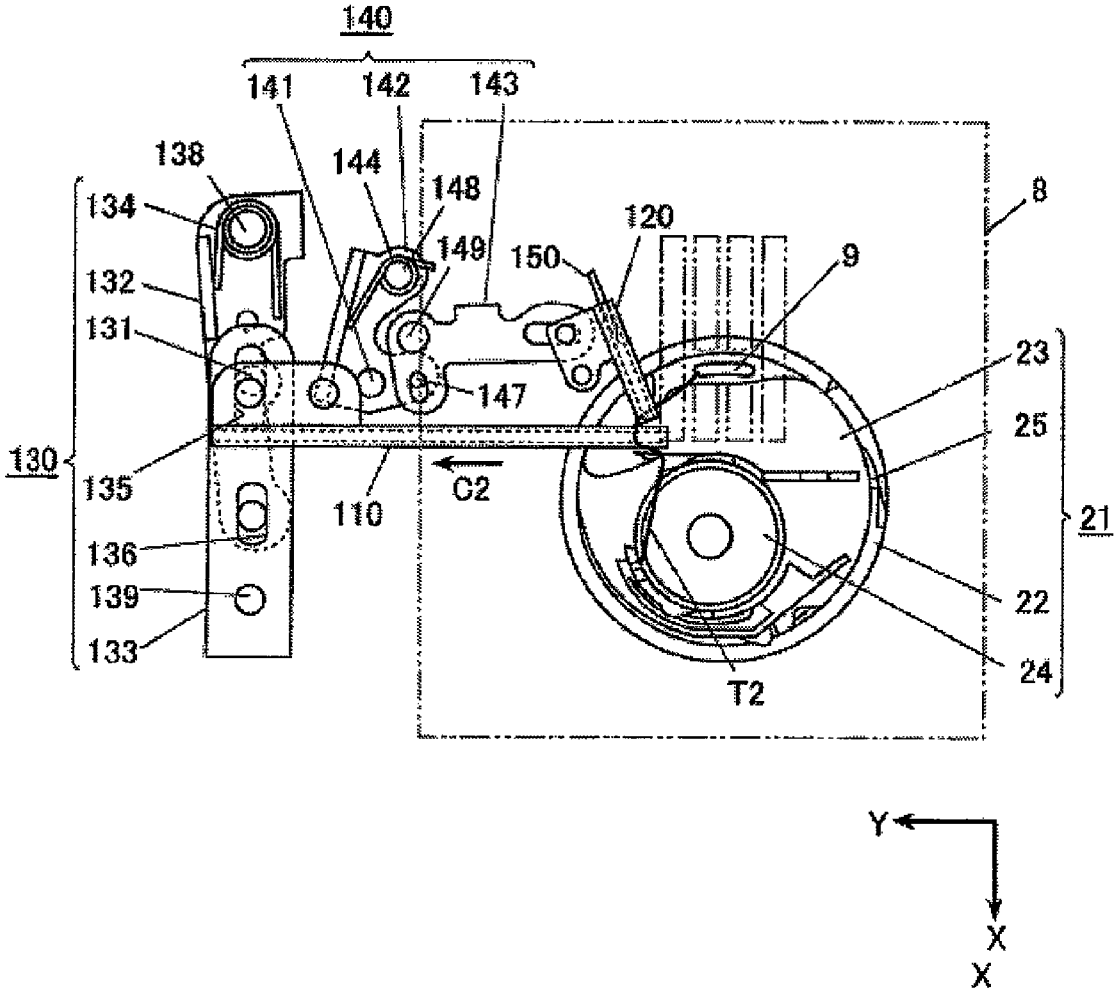
FIG. 14B is a view for explaining the operation of the thread cutting device.

When the first thread catching body 110 is moved to the foremost position, the CPU 51 executes a processing of rotating the thread catching body driving stepping motor 180 in a reverse direction at a low speed through the driving circuit 59 (Step S5), thereby rotating the thread catching body driving cam 170 in a reverse direction and moving the first thread catching body 110 backward at a low speed through the first link mechanism 130 (Step S6). Consequently, the first thread catching body 110 carries out the backward movement so that the bobbin thread T is caught by the thread catching portion 111 (Step S7), and furthermore, is slowly pulled out of the bobbin 24. When the thread catching body driving cam 170 is reversely rotated to a position placed at 90 degrees from the initial position as shown in FIG. 14A (Step S8) and the first thread catching body 110 is moved backward (a first half) to the needle thread catching position in the middle of the backward movement as shown in FIG. 14B, thereafter, the CPU 51 executes a processing of stopping the stepping motor 180 through the driving circuit 59 (Step S9) and driving the sewing machine motor 5 by the driving circuit 56 (Step S10). As shown in FIG. 14B, in a state in which the stepping motor 180 is stopped at the Step S9, the first thread catching body 110 disposed in the needle thread catching position and the second thread catching body 120 disposed in the foremost position have tips which are brought face-to-face with each other, and the thread catching portion 111 and the thread catching portion 121 are arranged close to each other. In this state, only the bobbin thread T2 is caught by the thread catching portion 111 and neither of the threads (T1, T2) is caught by the thread catching portion 121.

Figure 15A:
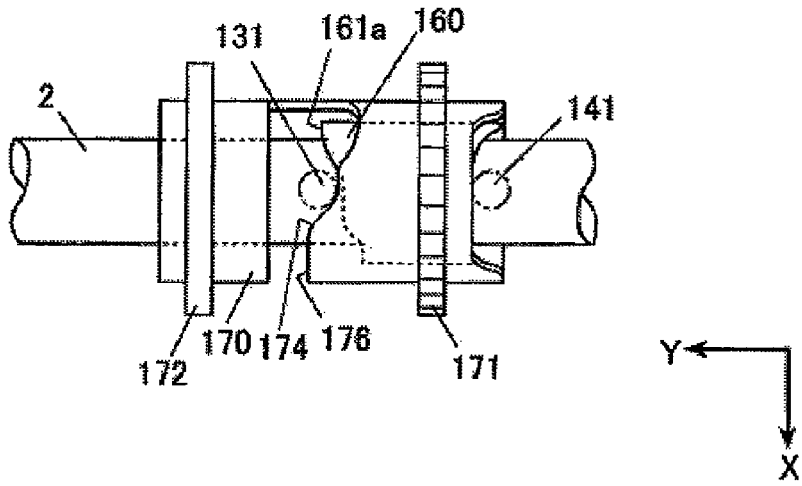
FIG. 15A is a view for explaining the operation of the thread catching body driving cam.
Figure 16A:
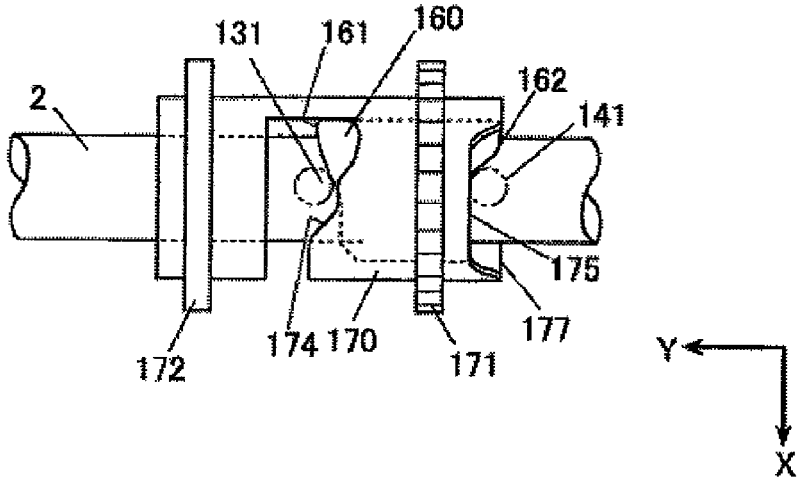
FIG. 16A is a view for explaining the operation of the thread catching body driving cam.
Figure 16B:
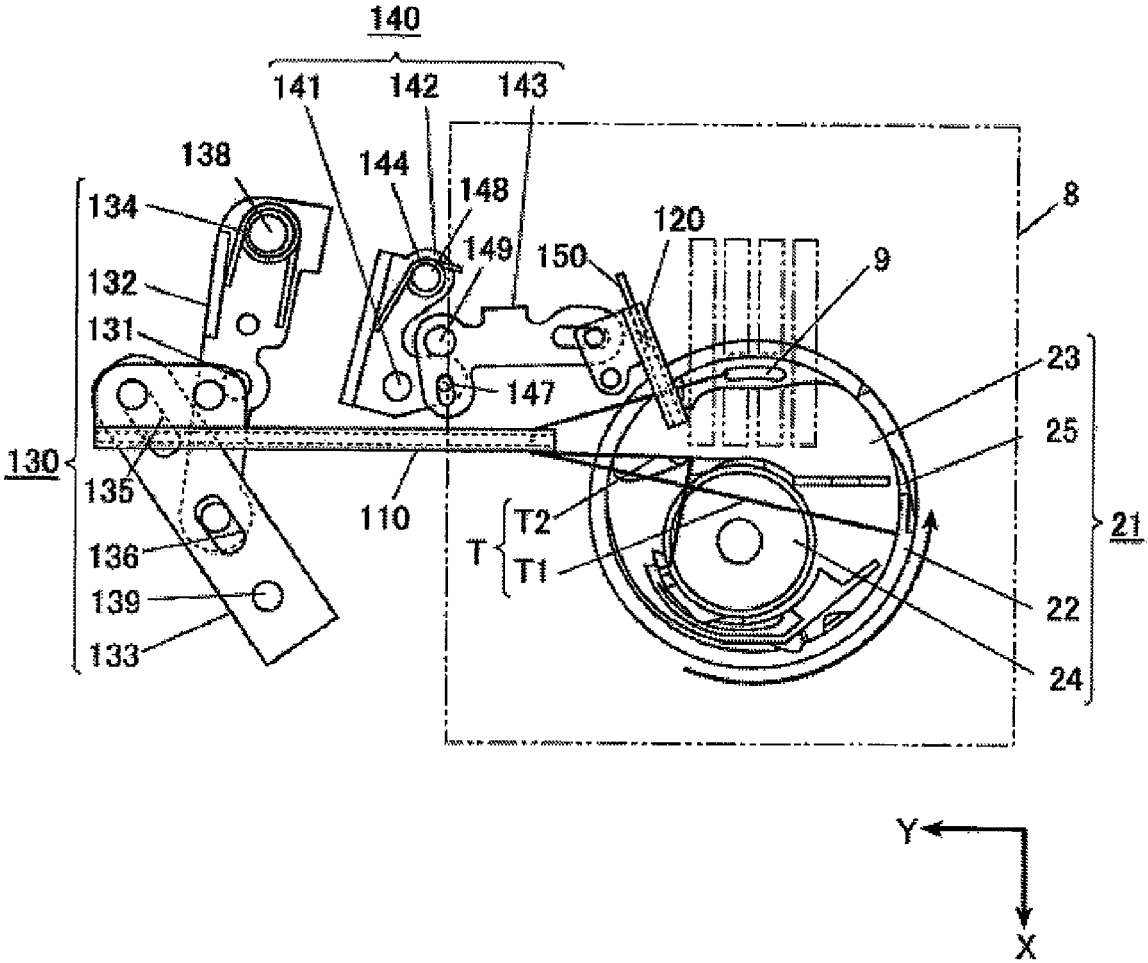
FIG. 16B is a view for explaining the operation of the thread cutting device.

When the sewing machine motor 5 is driven, the lower shaft 2 and the thread cutting cam 160 are rotated so that the horizontal shuttle 30 (the outer shuttle 22) coupled to the lower shaft 2 is rotated as shown in FIGS. 15A and 16A (Step S11).

Figure 15B:
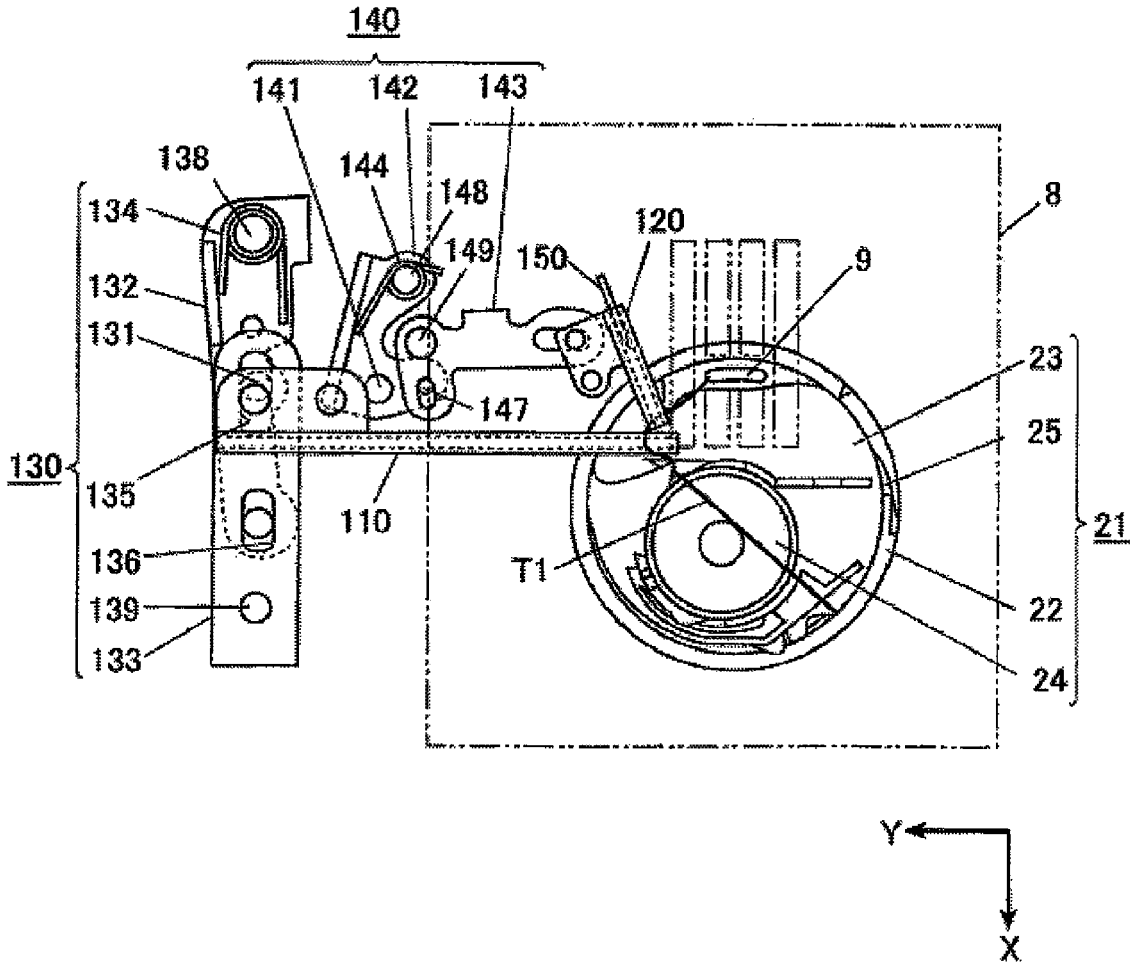
FIG. 15B is a view for explaining the operation of the thread cutting device.

As described above, the horizontal shuttle 30 (the outer shuttle 22) is rotated at a double rotating speed of that of the lower shaft 2. When the lower shaft 2 carries out a half rotation, that is, a rotation of approximately 180 degrees, therefore, the horizontal shuttle 30 (the outer shuttle 22) carries out a rotation of approximately 360 degrees, that is, one rotation. In other words, the needle thread passing through the outer shuttle 22 is caught by the thread catching portions 111 and 121 of the thread catching members 110 and 120 at the same time as shown in FIG. 15B while the lower shaft 2 and the thread cutting cam 160 carry out a half rotation (Step S12). More specifically, at this time, the needle thread T1 and the bobbin thread T2 are caught by the thread catching portion 111 and the needle thread T1 is caught by the thread catching portion 121. When the end cam portion 161 of the thread cutting cam 160 is rotated to such a position as to abut on the cam abutting portion 131 as shown in FIG. 15A, moreover, the end cam portion 161 of the thread cutting cam 160 is used as the driver and the cam abutting portion 131 to be the follower is moved in the leftward direction along the end cam portion 161 as shown in FIG. 16A. Consequently, the first thread catching body 110 is further moved backward (a second half).

By the backward movement of the first thread catching body 110 from the needle thread catching position to the rearmost position, an angle of the bobbin thread T2 which is caught by the thread catching portion 111 and is laid between the thread catching portion 121 and the needle hole 9 is changed as shown in FIG. 18. More specifically, by the backward movement of the first thread catching body 110 (the second half), the bobbin thread T2 laid between the thread catching portion 111 and the needle hole 9 is changed to be almost parallel with the Y-axis direction as seen from a plane around the needle hole 9. In the embodiment, the bobbin thread T2 is guided to a lower part along a curved surface of the tip of the second thread catching body 120 and is caught by the thread catching portion 121 through the change in the angle of the bobbin thread T2. In a state in which the first thread catching body 110 is disposed in the rearmost position shown in FIG. 16B, accordingly, the needle thread T1 and the bobbin thread T2 are caught by the thread catching portion 111 and are also caught by the thread catching portion 121 (Step S13).

Thereafter, the thread catching portion 121 of the second thread catching member 120 is further moved backward via the thread cutting position and is thus moved to the rearmost position (Step S14). As shown in FIG. 17B, consequently, the needle thread T1 and the bobbin thread T2 which are led to the fixed blade 150 through the thread catching portion 121 are cut (Step S5).

Figure 17A:
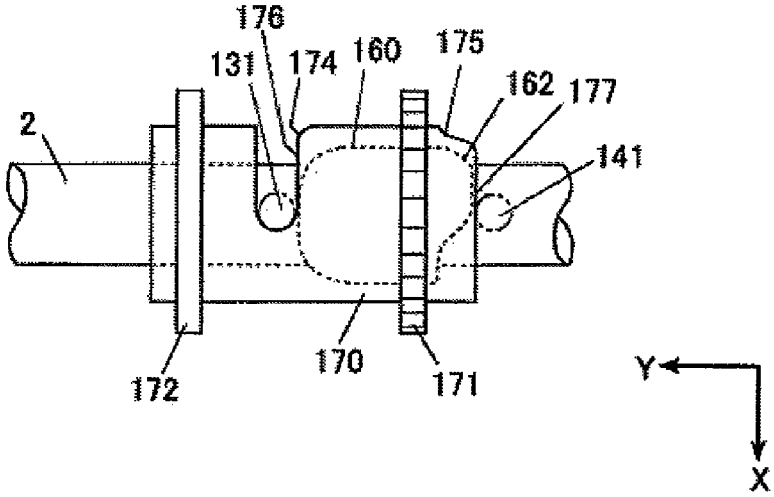
FIG. 17A is a view for explaining the operation of the thread catching body driving cam.
Figure 17B:
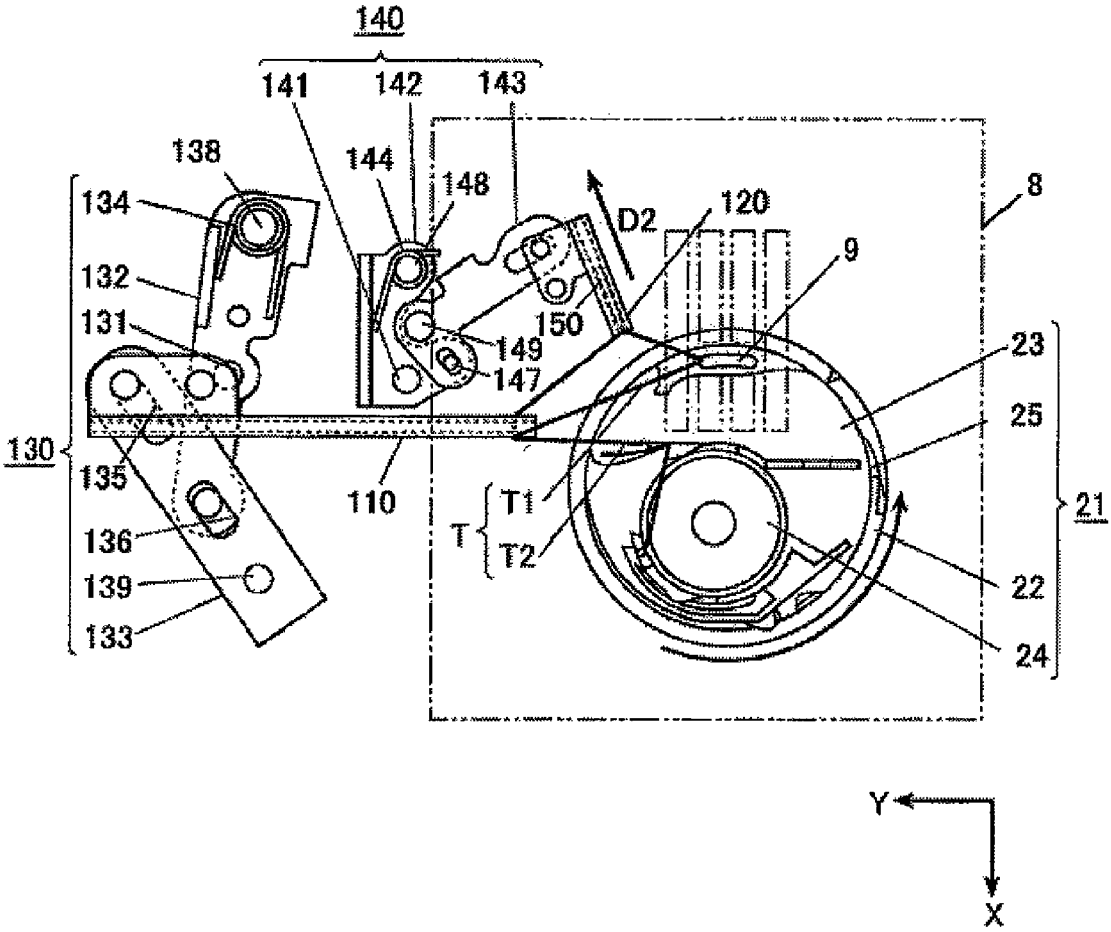
FIG. 17B is a view for explaining the operation of the thread cutting device.

When the lower shaft 2 and the thread cutting cam 160 are rotated by 180 degrees as shown in FIG. 17A, then, the cam abutting portion 131 to be the follower is guided to the tip 161*a* of the end cam portion 161 in the thread cutting cam 160 and the first thread catching body 110 is moved backward to the vicinity of a standby position to be an initial position. Moreover, the cam abutting portion 141 is guided to a tip of the end cam portion 162 in the thread cutting cam 160 and the second thread catching body 120 is moved backward to the vicinity of a standby position to be an initial position.

Furthermore, the CPU 51 executes a processing of stopping the sewing machine motor 5 by the driving circuit 5G (Step S16) and then restarting the reverse driving operation (the second half) of the stepping motor 180 by the driving circuit 59, thereby driving the thread catching body driving cam 170 to an original position in a reverse direction (a return direction) (Step S17). Consequently, the thread catching body driving cam 170 is rotated to an initial position (zero degree) in the reverse direction and the cam abutting portion 131 is guided into the standby portion 176 of the peripheral cam portion 174, and furthermore, the cam abutting portion 141 is guided to the standby portion 177 of the end cam portion 175. Accordingly, both the first thread catching body 110 and the second thread catching body 120 are held in the rearmost positions (Step S18) and a sewing enable state is brought so that the thread cut processing is ended.

Advantage of the Embodiment

Figure 19:
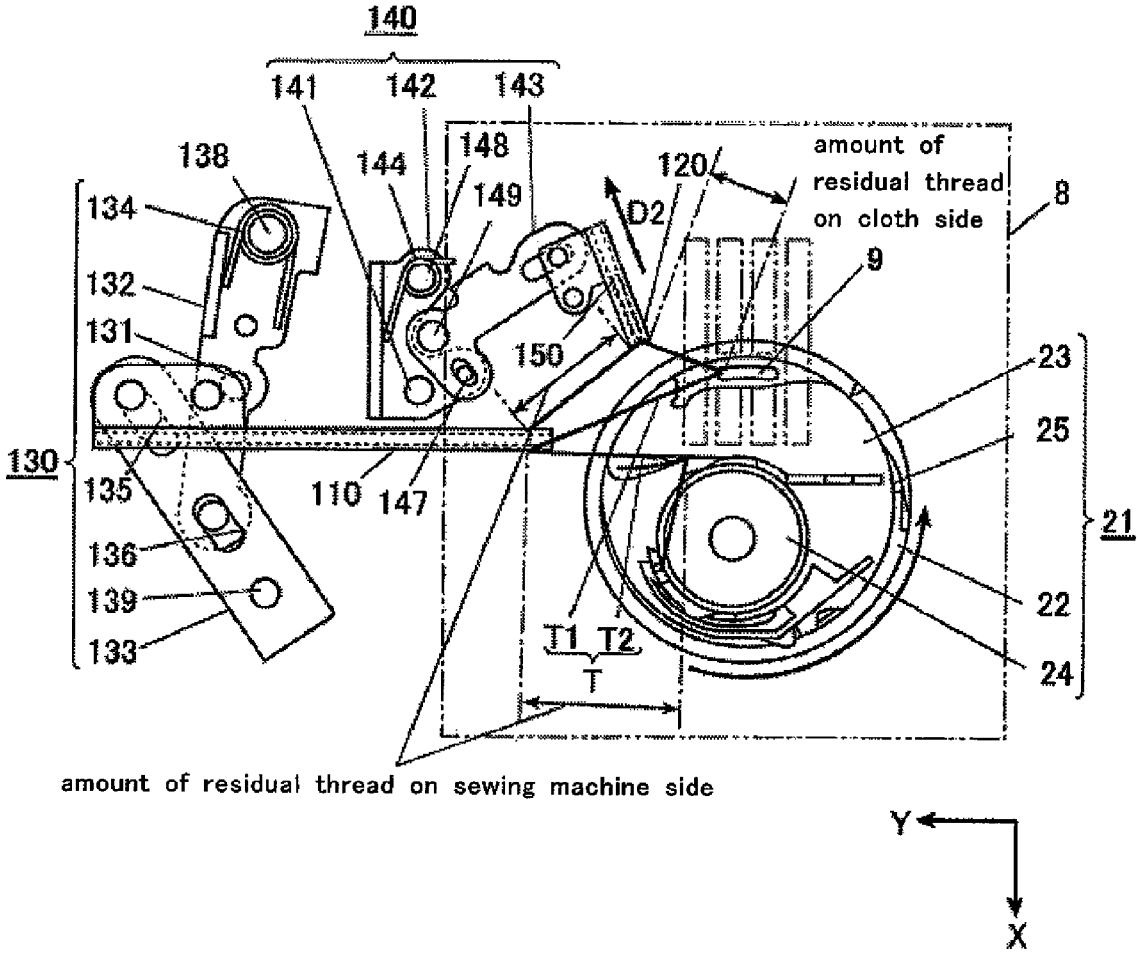
FIG. 19 is a view for explaining an amount of a residual thread in the thread cutting device of the sewing machine according to the invention.
Figure 20A:
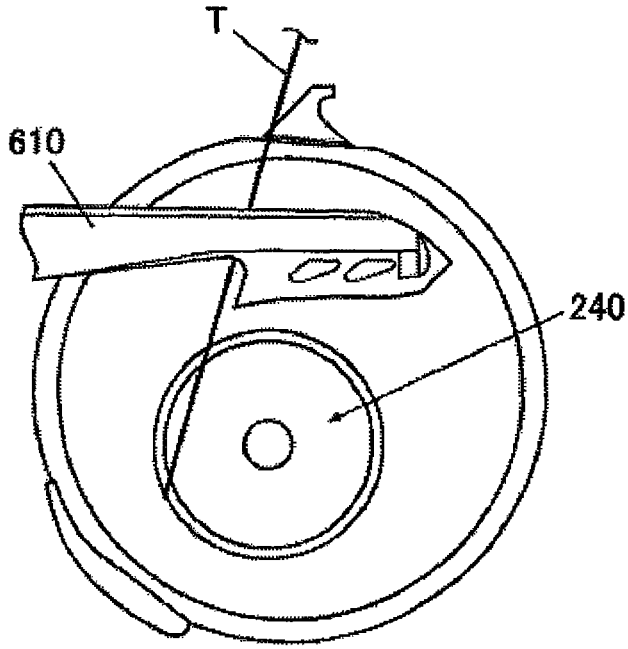
FIG. 20A is a typical view showing a thread catching operation in a thread cutting device of a conventional sewing machine, which shows a state brought before the catching operation
Figure 20B:
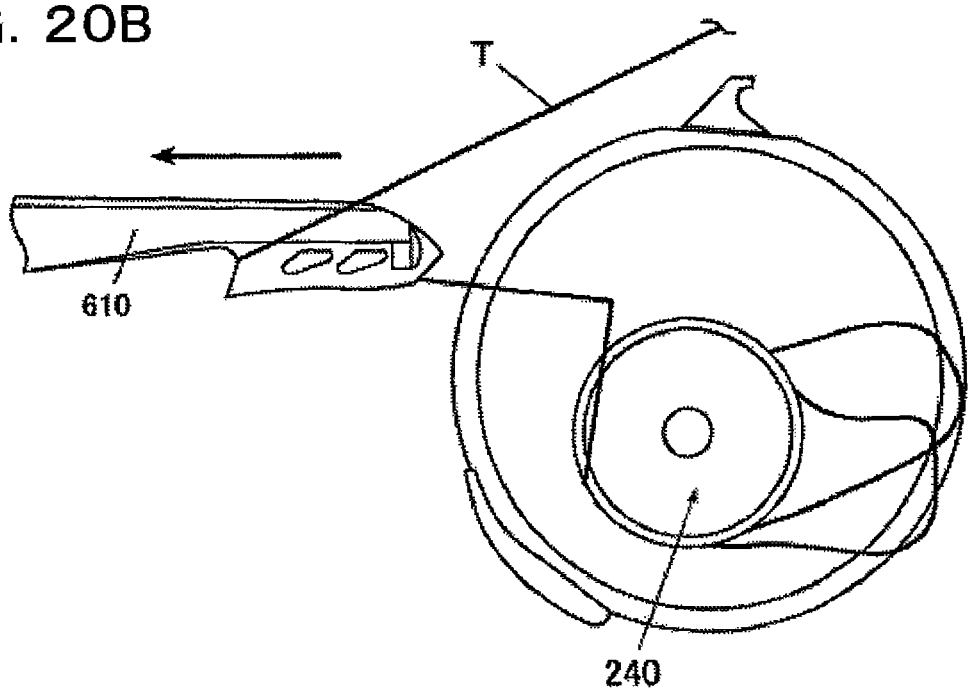
FIG. 20B is a typical view showing a thread catching operation in a thread cutting device of a conventional sewing machine, which shows a state brought after the catching operation.
Figure 21:
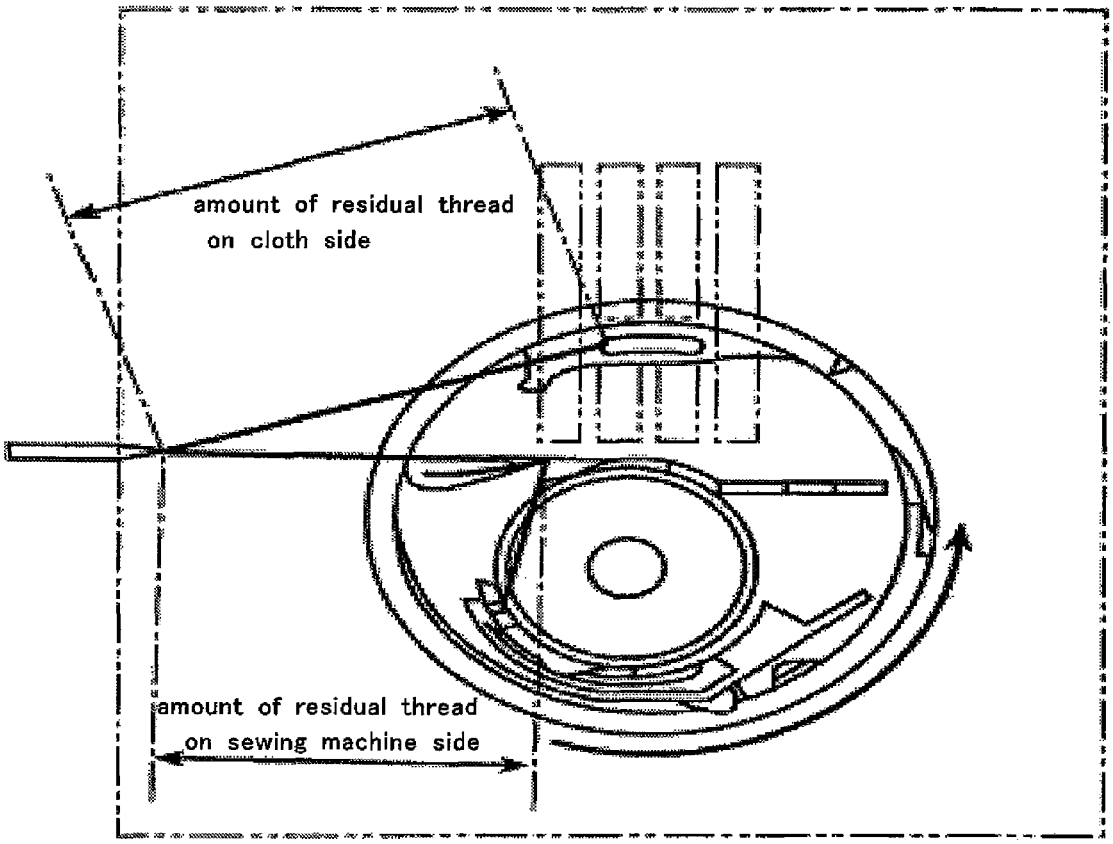
FIG. 21 is an explanatory view showing an amount of a residual thread in the thread cutting device of the conventional sewing machine.

As described above, according to the thread cutting mechanism 100 in accordance with the embodiment, there is employed the structure in which the thread T is caught by the first thread catching body 110 and the thread T laid between the thread catching portion 111 of the first thread catching body 110 and the needle hole 9 is further caught by the second thread catching body 120 and is guided to the fixed blade 150, and is thus cut by the fixed blade 150. Consequently, it is possible to cut a portion of the thread T which is closer to the needle hole 9. As compared with a thread cutting device of a conventional sewing machine which serves to guide the thread T caught by the first thread catching body 110 to the fixed blade 150 and to cut the thread T by the fixed blade 150, accordingly, it is possible to reduce a length of a residual end of the thread T remaining on the cloth side after the cutting work more greatly and to maintain a greater length of the residual end of the thread T remaining on the sewing machine 1 side because of the fold-back of the thread T through the first thread catching body 110 (see FIG. 19). Consequently, it is possible to cut the thread T to have a proper length, thereby reducing a labor and a time which are required for the processing for the residual end of the thread T remaining on the cloth side, and to efficiently entangle the thread T in a next sewing work. Therefore, the work may be efficiently carried out.

Moreover, the first link mechanism 130 and the second link mechanism 140 have the followers (131, 141) capable of abutting on the drivers of both the thread cutting cam 160 to be operated through the sewing machine motor 5 and the thread catching body driving cam 170 to be operated through the stepping motor 180, respectively. Consequently, the control portion 50 may selectively switch the driving source for driving the first thread catching body 110 and the driving source for driving the second thread catching body 120 into one of the sewing machine motor 5 and the stepping motor 180. More specifically, the control portion 50 uses the stepping motor 180 as the driving source to drive the first thread catching body 110, thereby catching the thread T and then drives the sewing machine motor 5 to drive the second thread catching body 120, thereby cutting the thread T guided to the fixed blade 150. Consequently, the control portion 50 drives the stepping motor 180 serving as the driving source at a low speed in the catching operation of the first thread catching body 110. Thus, it is possible to carry out the operation for catching the thread T through the first thread catching body 110 at a low speed. Accordingly, it is possible to pull the thread T out of the bobbin 24 at a low speed. As a result, it is possible to prevent excessive pull-out in which the thread T is excessively pulled out of the bobbin 24. Moreover, the sewing machine motor 5 is used as the driving source for guiding the thread T to the fixed blade 150 through the second thread catching body 120 and cutting the thread T by the fixed blade 150. As compared with the case in which the stepping motor 180 is used for the driving source in the cutting operation, consequently, it is possible to increase a cutting force. As a result, it is possible to execute the thread cutting operation without considering a type of the thread T to be used (for example, a thickness or a hardness). Therefore, it is possible to prevent a thread cutting failure.

Moreover, the thread catching body driving cam 170 is disposed concentrically with the thread cutting cam 160 and retains the thread cutting cam 160 on the inside. In addition, the thread cutting cam 160 is set to be the end cam having the drivers on both end faces and the thread catching body driving cam 170 is set to be the cylindrical cam having the drivers on the peripheral surface and one of the end faces in the axis direction. Consequently, it is possible to obtain the respective advantages while reducing a space in the bed portion 12.

Furthermore, the cam abutting portions 131 and 141 to be the followers are held by the standby portions 176 and 177 to be the abutting portions in the sewing work. Consequently, it is possible to prevent the interference of the driver of the thread cutting cam 160 to be rotated together with the lower shaft 2 and the followers of the first link mechanism 130 and the second link mechanism 140, thereby implementing a smooth sewing operation.

By driving the sewing machine motor 5 in a state in which the second thread catching body 120 is disposed in the foremost position and the first thread catching body 110 is disposed in the thread catching position in the middle of the backward movement, moreover, both of the thread catching portions 111 and 121 may efficiently catch the thread T which is caught by the outer shuttle 22 to be interlocked with the sewing machine motor 5 and passes through the horizontal shuttle 21. By the structure in which the first thread catching body 110 catching the thread T is moved backward to the rearmost position with the second thread catching body 120 disposed in the foremost position, furthermore, it is possible to easily cause the thread catching portion 121 of the second thread catching body 120 to catch the thread T caught by the first thread catching body 110 through the backward movement of the first thread catching body 110.

In addition, the thread catching portion 121 of the second thread catching body 120 passes through a height in which the thread T laid between the thread catching portion 111 of the first thread catching body 110 and the needle hole 9 may be caught. Consequently, it is possible to enhance a reliability of the catching operation for catching the thread T and the cutting operation for cutting the thread T.

(Others)

Although there is employed the structure in which the stepping motor 180 is driven in response to the input of the thread cutting signal with the press-down of the thread cutting button 30 in the embodiment, it is also possible to provide detecting means for detecting that the lower shaft 2 is positioned at a predetermined rotating angle (which may be the main shaft position detecting sensor 7, for example), thereby causing the control portion 50 to carry out a control for automatically driving the stepping motor 180 in response to the detection signal sent from the detecting means, for instance.

Moreover, the control portion 50 may sequentially execute the thread cutting operation by driving the thread catching body driving stepping motor 180 and the sewing machine motor 5 when ending the sewing work based on the preset sewing data.

Furthermore, it is sufficient that the springs 134 and 144 may energize the first thread catching body 110 and the second thread catching body 120 in the forward moving directions respectively, and may be energizing means having an elastic member such as a rubber.

What is claimed is:

1. A thread cutting device of a sewing machine which is disposed below a throat plate having a needle hole through which a needle for carrying out a needle oscillating motion in an orthogonal direction to a cloth feeding direction penetrates and serves to cut at least one of a needle thread and a bobbin thread which are positioned between a horizontal shuttle and the needle hole, the thread cutting device comprising;

a fixed blade;

a first thread catching member having a first thread catching portion for catching a thread positioned between the horizontal shuttle and the needle hole and carrying out forward and backward movements below the throat plate while the first thread catching portion catches the thread;

a second thread catching member having a second thread catching portion for catching the thread laid between the needle hole and the first thread catching portion and guiding the thread caught by the first thread catching member to the fixed blade and to cut the thread by the fixed blade; and an operating device for causing the second thread catching member to catch the thread and cut the thread caught by the first thread catching member, wherein the first thread catching member serves to carry out forward and backward movements in a needle oscillating direction, and the bobbin thread laid between the first thread catching member and the needle hole is changed to be parallel with the needle oscillating direction by the forward and backward movements, and wherein the second thread catching member serves to carry out the forward and backward movements to an approaching/separating position to/from a movement path of the first thread catching member on a path intersecting with the movement path of the first thread catching member.

2. The thread cutting device of a sewing machine according to claim 1, wherein the operating device includes a stepping motor serving as a driving source for the catching operation of the first thread catching member.

3. The thread cutting device of a sewing machine according to claim 2, wherein the operating device further includes:

a first cam member provided on a lower shaft to be rotated by a sewing machine motor;

a second cam member provided side by side with the first cam member and driven by the stepping motor;

a first power transmitting member having a follower capable of abutting on driver portion of both the first cam member and the second cam member and transmitting a power for forward and backward movements from the first and second cam members to the first thread catching member;

a second power transmitting member having a follower capable of abutting on drivers of both the first cam member and the second cam member and transmitting a power for forward and backward movements from the first and second cam members to the second thread catching member; and a control unit which drives the stepping motor to move the first thread catching member to catch the thread, and then drives the sewing machine motor to move the second thread catching member to cut the thread.

4. The thread cutting device of a sewing machine according to claim 3, wherein the first cam member comprises an end cam having first drivers on both end faces of the first cam member in an axis direction of the lower shaft, and the second cam member comprises a cylindrical cam disposed concentrically with the first cam member and retaining the first cam member on an inside of the second cam member, and having second drivers on a peripheral surface thereof and one of the end faces of the second cam member in the axis direction of the lower shaft.

5. The thread cutting device of a sewing machine according to claim 3, wherein the second driver of the second cam member comprises an abutting portion for moving the first thread catching member and the second thread catching member backward, and holding each of the followers in a position in which any of the first driver of the first cam member and the respective followers are disengaged with each other.

6. The thread cutting device of a sewing machine according to claim 3, wherein the second cam member has the second drivers on the peripheral surface and one of the end faces in the axis direction of the lower shaft which guide the respective followers to move both the first thread catching member and the second thread catching member from a rearmost position to a foremost position through a normal rotation of the stepping motor and to then dispose the first thread catching member in a thread catching position in a middle of the backwardly movement while disposing the second thread catching member in the foremost position through a reverse rotation of the stepping motor with respect of the normal rotation, and the first cam member has the drivers on both of the end faces in the axis direction of the lower shaft which guide the respective followers to backwardly move the first thread catching member catching the thread to the rearmost position while disposing the second thread catching member in the foremost position through a driving operation of the sewing machine motor and to then move the second thread catching member to the rearmost position.

7. The thread cutting device of a sewing machine according to claim 1, wherein the second thread catching member passes through a height in which the thread laid between the first thread catching portion of the first thread catching member and the needle hole is caught by the second thread catching portion.

* * * * *